US006451752B1

(12) United States Patent
Delroisse et al.

(10) Patent No.: US 6,451,752 B1
(45) Date of Patent: Sep. 17, 2002

(54) METHOD OF PRETREATING AND BLEACHING STAINED FABRICS

(75) Inventors: Michel Gilbert Delroisse; David Andrew Jones; Richard George Smith; John Francis Wells, all of Bebington, Wirral (GB)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 190 days.

(21) Appl. No.: 09/650,139

(22) Filed: Aug. 29, 2000

(30) Foreign Application Priority Data

Sep. 1, 1999 (GB) ..... PCT/GB99/02878
Feb. 29, 2000 (GB) ..... 0004844

(51) Int. Cl.[7] ..... C11D 3/00; C11D 3/395; C11D 17/04

(52) U.S. Cl. ..... 510/370; 510/283; 510/284; 510/303; 510/367; 510/370; 510/375; 510/376

(58) Field of Search ..... 510/367, 370, 510/375, 376, 283, 284, 303

(56) References Cited

U.S. PATENT DOCUMENTS 4,217,105 A 8/1980 Goodman

FOREIGN PATENT DOCUMENTS

| | | |
|---|---|---|
| DE | 19714122 | 4/1997 |
| DE | 19721886 | 5/1997 |
| EP | 0 040 131 | 4/1985 |
| EP | 0 909 809 | 9/1998 |
| JP | 2000/034497 | 2/2000 |
| WO | 95/27772 | 10/1995 |
| WO | 95/34628 | 12/1995 |
| WO | 96/06154 | 2/1996 |
| WO | 97/07124 | 2/1997 |
| WO | 97/38074 | 10/1997 |
| WO | 97/48710 | 12/1997 |
| WO | 97/48787 | 12/1997 |
| WO | 00/12667 | 3/2000 |
| WO | 00/12808 | 3/2000 |

OTHER PUBLICATIONS

Journal of Surfactants and Detergents, vol. 1, No. 2, (Apr. 1998), "Oxygen Bleaching System in Domestic Laundry" by Neil J. Milne, pp. 253–261.

*Primary Examiner*—Yogendra N. Gupta
*Assistant Examiner*—John M Petruncio
(74) *Attorney, Agent, or Firm*—Milton L. Honig

(57) ABSTRACT

A method for bleaching stained fabrics is provided by pretreating the stained fabric, before washing, with a pretreatment composition that comprises a ligand that forms a transition metal complex as bleach catalyst, the complex catalysing bleaching of stains by atmospheric oxygen. The pretreatment composition preferably comprises an iron complex comprising the ligand N,N-bis(pyridin-2-yl-methyl)-1,1-bis(pyridin-2-yl)-1-aminoethane. One or both of the pretreatment composition and the wash liquor are substantially devoid of peroxygen bleach or a peroxy-based or -generating bleach system. The pretreatment provides improved or broader stain profile bleaching.

13 Claims, No Drawings

METHOD OF PRETREATING AND BLEACHING STAINED FABRICS

FIELD OF INVENTION

This invention relates to a method for bleaching stained fabrics, more particularly by pretreating the stained fabric, before washing, with a pretreatment composition that comprises an organic ligand that forms a transition metal complex as bleach catalyst. The invention further relates to the use of the ligand or complex in a pretreatment composition for applying to stained fabrics prior to washing in an aqueous wash liquor.

BACKGROUND OF INVENTION

EP-A-0909809 discloses a class of iron coordination complexes useful as catalysts for the bleach activation of peroxy compounds, including iron complexes comprising the ligand N,N-bis(pyridin-2-yl-methyl)-1,1-bis(pyridin-2-yl)-1-aminoethane, also referred to as MeN4Py. These catalysts are said to be useful in bleaching systems comprising a peroxy compound or a precursor thereof, such as in the washing and bleaching of substrates including laundry, dishwashing and hard surface cleaning, or for bleaching in the textile, paper and woodpulp industries, and in waste water treatment.

In our co-pending application PCT/GB99/02876, we describe methods for catalytically bleaching substrates with atmospheric oxygen in aqueous medium, using metal ligand complexes as catalytic bleaching agents. These methods are said to be particularly applicable to bleaching of laundry fabrics, suitably in detergent formulations, but also may be used for hard surface cleaning, waste-water treatment, pulp bleaching in paper manufacture, leather manufacture, dye transfer inhibition, food processing, starch bleaching, sterilisation, whitening in oral hygiene preparations and/or contact lens disinfection.

However, there remains a need for improved methods of bleaching stained laundry fabrics. Thus, it would be desirable to be able to effect improved bleaching of particular stain types. It would also be desirable to be able to bleach a broader profile of stain types more effectively.

SUMMARY OF INVENTION

We have now found that improved or broader stain profile bleaching can be achieved in accordance with the present invention, by using a specified ligand or transition metal complex bleach catalyst to pretreat stained fabrics prior to washing.

Accordingly, in a first aspect, the present invention provides a method of bleaching fabric stains comprising applying a pretreatment composition to a stained fabric, and subsequently washing the pretreated fabric in an aqueous wash liquor, wherein:

- the pretreatment composition comprises a ligand which forms a complex with a transition metal, the complex catalysing bleaching of stains by atmospheric oxygen; and
- one or both of the pretreatment composition and the wash liquor are substantially devoid of peroxygen bleach or a peroxy-based or -generating bleach system.

In a second aspect, the present invention provides the use of a ligand which forms a complex with a transition metal, the complex catalysing bleaching of stains by atmospheric oxygen, in a pretreatment composition for applying to stained fabrics prior to stain bleaching by washing the pretreated fabric in an aqueous wash liquor.

Preferably, the ligand is N,N-bis(pyridin-2-yl-methyl)-1,1-bis(pyridin-2-yl)-1-aminoethane, and the complex is an iron complex.

We have found that certain stain types can be more effectively bleached on stained fabrics by the pretreatment. Thus, the bleaching of oily stains such as tomato stain can be improved by the pretreatment. For stains of this type, a peroxygen bleach such as hydrogen peroxide, or a peroxy-based or -generating bleach system, may be present or absent in the pretreatment composition, but preferably is absent. Bleaching of tea stains may also be improved by the pretreatment. For stains of this type, a peroxygen bleach such as hydrogen peroxide, or a peroxy-based or -generating bleach system, should be present in the pretreatment composition.

In order to provide a more effective bleaching performance over a range of different stain types, it is preferred that one of the pretreatment composition and the wash liquor comprises a peroxygen bleach such as hydrogen peroxide or a peroxy-based or -generating bleach system. Thus, the other of the pretreatment composition and the wash liquor is free of peroxygen bleach or a peroxy-based or -generating bleach system. Since the specificity of catalytic bleaching for particular stain types may be altered according to the presence or absence of peroxygen bleach or a peroxy-based or -generating bleach systems, a broader stain profile may be bleached more effectively by ensuring that either the pretreatment or the wash liquor, but not both, comprise peroxy bleach.

For example, it may be postulated that catalytic bleaching with atmospheric oxygen will predominate in the wash liquor during the wash cycle when the wash liquor is substantially devoid of peroxygen bleach or a peroxy-based or -generating bleach system, so as to favour bleaching of tomato stain types over tea stain types, whereas peroxy bleach catalysis will predominate during the pretreatment if the pretreatment composition comprises peroxygen bleach or a peroxy-based or -generating bleach system, so as to favour bleaching of tea stain types over tomato stain types.

Alternatively, the peroxygen bleach or peroxy-based or -generating bleach system could absent from the pretreatment composition and present only in the wash liquor so as to favour the bleaching of tomato stain types during the pretreatment and the bleaching of tea stain types during the main wash cycle. By altering the specificity of bleaching for particular stain types between the pretreatment step and the main wash step, a broad stain profile bleaching can be effected.

In a preferred embodiment, therefore, the pretreatment composition comprises peroxygen bleach or a peroxy-based or -generating bleach system and the wash liquor is substantially devoid of peroxygen bleach or a peroxy-based or -generating bleach system. In this embodiment, preferably the stained fabric comprises a tea stain.

In an alternative embodiment, the pretreatment composition is substantially devoid of peroxygen bleach or a peroxy-based or -generating bleach system and the wash liquor comprises peroxygen bleach or a peroxy-based or -generating bleach system. In this embodiment, preferably the stained fabric comprises a tomato, oil or tomato/oil stain.

We have also found that the bleaching effect on certain stain types, for example tomato/oil stain types, may be enhanced by the presence of unsaturated fatty acids, such as oleic acid, or esters thereof, preferably unsaturated fatty acid oils, in the pretreatment composition. Therefore, in a preferred embodiment, the pretreatment composition comprises an unsaturated fatty acid oil in combination with the ligand or complex. The unsaturated fatty oils are relatively inexpensive and it is postulated that similar materials will serve to provide a similar bleach enhancing activity. Enhancement of the bleaching process will likely be found in compounds having a hydrogen that is relatively prone to abstraction by a free radical. Other examples of compounds that are likely suitable as bleach enhancers are found in compounds containing an allylic hydrogen, a hydrogen alpha to an ether (anomeric effect), a hydrogen alpha to an amine, a benzylic hydrogen etc.

Any suitable fabric that is susceptible to stain bleaching or one that one might wish to subject to bleaching may be used. Preferably the fabric is a laundry fabric or garment. In a preferred embodiment, the method according to the present invention is carried out on a laundry fabric using an aqueous pretreatment composition. In particular, the treatment may be effected prior to a conventional wash cycle.

The pretreatment composition will comprise at least the ligand or complex in combination with a suitable medium, such as an aqueous or nonaqueous solvent, or an inert carrier such as a filler. It will be appreciated that the composition may take any suitable form, such as a solid, powder, paste, gel or liquid. Preferably, the pretreatment composition is in the form of a liquid.

The pretreatment composition may be applied to the stained fabric by any suitable delivery method, for example by spraying as a liquid or dry powder, from a liquid, gel or paste applicator, or from a bar. Preferably, the pretreated fabric is left for at least 5 minutes, preferably at least 15 minutes, more preferably at least 50 minutes, before washing.

The pretreatment composition may be contacted to the textile fabric in any suitable manner. For example, it may be applied in dry form, such as in powder form, particularly to wetted fabrics, or in a liquor, for example as an aqueous spray-on fabric treatment fluid, or a non-aqueous dry cleaning fluid or spray-on aerosol fluid, to dry or wet fabrics.

Suitable pretreatment means for application of the ligand or complex to the textile material prior to the main wash include sprays, pens, roller-ball devices, bars, soft solid applicator sticks and impregnated cloths or cloths containing microcapsules. Such means are well known in the analogous art of deodorant application and/or in spot treatment of textiles.

The present invention also extends to a commercial package comprising a ligand or complex preferably as defined below together with instructions for its use.

DETAILED DESCRIPTION OF THE INVENTION

The catalyst may comprise a preformed complex of a ligand and a transition metal. Alternatively, the catalyst may comprise a free ligand that complexes with a transition metal already present in the water or that complexes with a transition metal present in the substrate. The catalyst may also be included in the form of a composition of a free ligand or a transition metal-substitutable metal-ligand complex, and a source of transition metal, whereby the complex is formed in situ in the medium.

The ligand forms a complex with one or more transition metals, in the latter case for example as a dinuclear complex. Suitable transition metals include for example: manganese in oxidation states II–V, iron II–V, copper I–III, cobalt I–III, titanium II–IV, tungsten IV–VI, vanadium II–V and molybdenum II–VI.

The transition metal complex preferably is of the general formula:

$$[M_aL_kX_n]Y_m$$

in which:

M represents a metal selected from Mn(II)–(III)–(IV)–(V), Cu(I)–(II)–(III), Fe (II)–(III)–(IV)–(V), Co(I)–(II)–(III), Ti(II)–(III)–(IV), V(II)–(III)–(IV)–(V), Mo(II)–(III)–(IV)–(V)–(VI) and W(IV)–(V)–(VI), preferably from Fe (II)–(III)–(IV)–(V);

L represents the ligand, preferably N,N-bis(pyridin-2-yl-methyl)-1,1-bis(pyridin-2-yl)-1-aminoethane, or its protonated or deprotonated analogue;

X represents a coordinating species selected from any mono, bi or tri charged anions and any neutral molecules able to coordinate the metal in a mono, bi or tridentate manner;

Y represents any non-coordinated counter ion;

a represents an integer from 1 to 10;

k represents an integer from 1 to 10;

n represents zero or an integer from 1 to 10;

m represents zero or an integer from 1 to 20.

Preferably, the complex is an iron complex comprising the ligand N,N-bis(pyridin-2-yl-methyl)-1,1-bis(pyridin-2-yl)-1-aminoethane. However, it will be appreciated that the pretreatment method of the present invention may instead, or additionally, use other ligands and transition metal complexes, provided that the complex formed is capable of catalysing stain bleaching by atmospheric oxygen. Suitable classes of ligands are described below:

(A) Ligands of the general formula (IA):

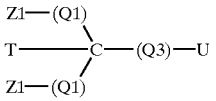

(IA)

wherein

Z1 groups independently represent a coordinating group selected from hydroxy, amino, —NHR or —$N(R)_2$ (wherein R=$C_{1-6}$-alkyl), carboxylate, amido, —NH—C(NH)$NH_2$, hydroxyphenyl, a heterocyclic ring optionally substituted by one or more functional groups E or a heteroaromatic ring optionally substituted by one or more functional groups E, the heteroaromatic ring being selected from pyridine, pyrimidine, pyrazine, pyrazole, imidazole, benzimidazole, quinoline, quinoxaline, triazole, isoquinoline, carbazole, indole, isoindole, oxazole and thiazole;

Q1 and Q3 independently represent a group of the formula:

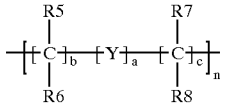

wherein

5≧a+b+c>1; a=0–5; b=0–5; c=0–5; n=0 or 1 (preferably n=0);

Y independently represents a group selected from —O—, —S—, —SO—, —$SO_2$—, —C(O)—, arylene, alkylene, heteroarylene, heterocycloalkylene, —(G)P—, —P(O)— and —(G)N—, wherein G is selected from hydrogen, alkyl, aryl, arylalkyl, cycloalkyl, each except hydrogen being optionally substituted by one or more functional groups E;

R5, R6, R7, R8 independently represent a group selected from hydrogen, hydroxyl, halogen, —R and —OR, wherein R represents alkyl, alkenyl, cycloalkyl, heterocycloalkyl, aryl, heteroaryl or a carbonyl derivative group, R being optionally substituted by one or more functional groups E, or R5 together with R6, or R7 together with R8, or both, represent oxygen, or R5 together with R7 and/or independently R6 together with R8, or R5 together with R8 and/or independently R6 together with R7, represent $C_{1-6}$-alkylene optionally substituted by $C_{1-4}$-alkyl, —F, —Cl, —Br or —I;

T represents a non-coordinated group selected from hydrogen, hydroxyl, halogen, —R and —OR, wherein R represents alkyl, alkenyl, cycloalkyl, heterocycloalkyl, aryl, arylalkyl, heteroaryl or a carbonyl derivative group, R being optionally substituted by one or more functional groups E (preferably T=—H, —OH, methyl, methoxy or benzyl);

U represents either a non-coordinated group T independently defined as above or a coordinating group of the general formula (IIA), (IIIA) or (IVA):

(IIA)

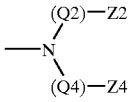

(IIIA)

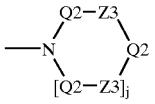

(IVA)

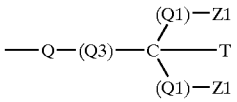

wherein

Q2 and Q4 are independently defined as for Q1 and Q3;

Q represents —N(T)— (wherein T is independently defined as above), or an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole;

Z2 is independently defined as for Z1;

Z3 groups independently represent —N(T)— (wherein T is independently defined as above);

Z4 represents a coordinating or non-coordinating group selected from hydrogen, hydroxyl, halogen, —NH—C(NH)$NH_2$, —R and —OR, wherein R=alkyl, alkenyl, cycloalkyl, heterocycloalkyl, aryl, heteroaryl or a carbonyl derivative group, R being optionally substituted by one or more functional groups E, or Z4 represents a group of the general formula (IIAa):

(IIAa)

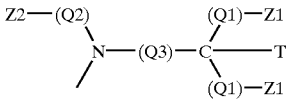

and $1 \leqq j < 4$.

Preferably, Z1, Z2 and Z4 independently represent an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole. More preferably, Z1, Z2 and Z4 independently represent groups selected from optionally substituted pyridin-2-yl, optionally substituted imidazol-2-yl, optionally substituted imidazol-4-yl, optionally substituted pyrazol-1-yl, and optionally substituted quinolin-2-yl. Most preferred is that Z1, Z2 and Z4 each represent optionally substituted pyridin-2-yl.

The groups Z1, Z2 and Z4 if substituted, are preferably substituted by a group selected from $C_{1-4}$-alkyl, aryl, arylalkyl, heteroaryl, methoxy, hydroxy, nitro, amino, carboxyl, halo, and carbonyl. Preferred is that Z1, Z2 and Z4 are each substituted by a methyl group. Also, we prefer that the Z1 groups represent identical groups.

Each Q1 preferably represents a covalent bond or C1–C4-alkylene, more preferably a covalent bond, methylene or ethylene, most preferably a covalent bond.

Group Q preferably represents a covalent bond or C1–C4-alkylene, more preferably a covalent bond.

The groups R5, R6, R7, R8 preferably independently represent a group selected from —H, hydroxy-$C_0$–$C_{20}$-alkyl, halo-$C_0$–$C_{20}$-alkyl, nitroso, formyl-$C_0$–$C_{20}$-alkyl, carboxyl-$C_0$–$C_{20}$-alkyl and esters and salts thereof, carbamoyl-$C_0$–$C_{20}$-alkyl, sulfo-$C_0$–$C_{20}$-alkyl and esters and salts thereof, sulfamoyl-$C_0$–$C_{20}$-alkyl, amino-$C_0$–$C_{20}$-alkyl, aryl-$C_0$–$C_{20}$-alkyl, $C_0$–$C_{20}$-alkyl, alkoxy-$C_0$–$C_8$-alkyl, carbonyl-$C_0$–$C_6$-alkoxy, and $C_0$–$C_{20}$-alkylamide. Preferably, none of R5–R8 is linked together.

Non-coordinated group T preferably represents hydrogen, hydroxy, methyl, ethyl, benzyl, or methoxy.

In one aspect, the group U in formula (IA) represents a coordinating group of the general formula (IIA):

(IIA)

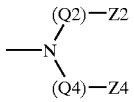

According to this aspect, it is preferred that Z2 represents an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole, more preferably optionally substituted pyridin-2-yl or optionally substituted benzimidazol-2-yl.

It is also preferred, in this aspect, that Z4 represents an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole, more preferably optionally substituted pyridin-2-yl, or an non-coordinating group selected from hydrogen, hydroxy, alkoxy, alkyl, alkenyl, cycloalkyl, aryl, or benzyl.

In preferred embodiments of this aspect, the ligand is selected from:

1,1-bis(pyridin-2-yl)-N-methyl-N-(pyridin-2-ylmethyl) methylamine;

1,1-bis(pyridin-2-yl)-N,N-bis(6-methyl-pyridin-2-ylmethyl)methylamine;

1,1-bis(pyridin-2-yl)-N,N-bis(5-carboxymethyl-pyridin-2-ylmethyl)methylamine;

1,1-bis(pyridin-2-yl)-1-benzyl-N,N-bis(pyridin-2-ylmethyl)methylamine; and 1,1-bis(pyridin-2yl)-N,N-bis(benzimidazol-2-ylmethyl) methylamine.

In a variant of this aspect, the group Z4 in formula (IIA) represents a group of the general formula (IIAa):

(IIAa)

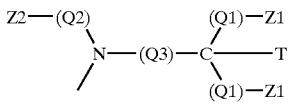

In this variant, Q4 preferably represents optionally substituted alkylene, preferably —$CH_2$—CHOH—$CH_2$— or —$CH_2$—$CH_2$—$CH_2$—. In a preferred embodiment of this variant, the ligand is:

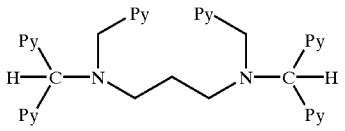

wherein —Py represents pyridin-2-yl.

In another aspect, the group U in formula (IA) represents a coordinating group of the general formula (IIIA):

(IIIA)

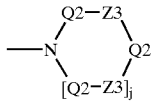

wherein j is 1 or 2, preferably 1.

According to this aspect, each Q2 preferably represents —$(CH_2)_n$— (n=2–4), and each Z3 preferably represents —N(R)— wherein R=—H or $C_{1-4}$-alkyl, preferably methyl.

In preferred embodiments of this aspect, the ligand is selected from:

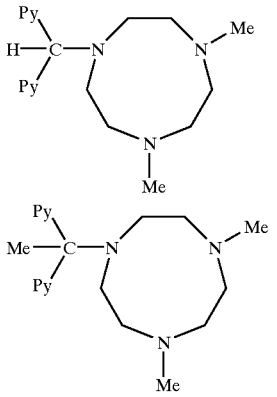

wherein —Py represents pyridin-2-yl.

In yet another aspect, the group U in formula (IA) represents a coordinating group of the general formula (IVA):

(IVA)

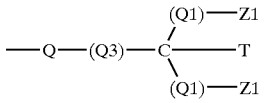

In this aspect, Q preferably represents —N(T)— (wherein T=—H, methyl, or benzyl) or pyridin-diyl.

In preferred embodiments of this aspect, the ligand is selected from:

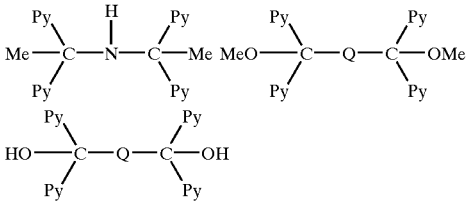

wherein —Py represents pyridin-2-yl, and —Q— represents pyridin-2,6-diyl.

(B) Ligands of the general formula (IB):

(IB)

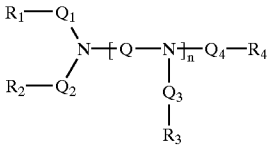

wherein n=1 or 2, whereby if n=2, then each —$Q_3$—$R_3$ group is independently defined;

$R_1$, $R_2$, $R_3$, $R_4$ independently represent a group selected from hydrogen, hydroxyl, halogen, —NH—C(NH)$NH_2$, —R and —OR, wherein R=alkyl, alkenyl, cycloalkyl, heterocycloalkyl, aryl, heteroaryl or a carbonyl derivative group, R being optionally substituted by one or more functional groups E, $Q_1$, $Q_2$, $Q_3$, $Q_4$ and Q independently represent a group of the formula:

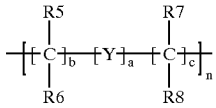

wherein

5≧a+b+c≧1; a=0–5; b=0–5; c=0–5; n=1 or 2;

Y independently represents a group selected from —O—, S—, —SO—, —$SO_2$—, —C(O)—, arylene, alkylene, heteroarylene, heterocycloalkylene, —(G)P—, —P(O)— and —(G)N—, wherein G is selected from hydrogen, alkyl, aryl, arylalkyl, cycloalkyl, each except hydrogen being optionally substituted by one or more functional groups E;

R5, R6, R7, R8 independently represent a group selected from hydrogen, hydroxyl, halogen, —R and —OR, wherein R represents alkyl, alkenyl, cycloalkyl, heterocycloalkyl, aryl, heteroaryl or a carbonyl derivative group, R being optionally substituted by one or more functional groups E, or R5 together with R6, or R7 together with R8, or both, represent oxygen, or R5 together with R7 and/or independently R6 together with R8, or R5 together with R8 and/or independently R6 together with R7, represent $C_{1-6}$-alkylene optionally substituted by $C_{1-4}$-alkyl, —F, —Cl, —Br or —I, provided that at least two of $R_1$, $R_2$, $R_3$, $R_4$ comprise coordinating heteroatoms and no more than six heteroatoms are coordinated to the same transition metal atom.

At least two, and preferably at least three, of $R_1$, $R_2$, $R_3$, $R_4$ independently represent a group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole.

Preferably, substituents for groups $R_1$, $R_2$, $R_3$, $R_4$, when representing a heterocyclic or heteroaromatic ring, are selected from $C_{1-4}$-alkyl, aryl, arylalkyl, heteroaryl, methoxy, hydroxy, nitro, amino, carboxyl, halo, and carbonyl.

The groups $Q_1$, $Q_2$, $Q_3$, $Q_4$ preferably independently represent a group selected from —$CH_2$— and —$CH_2CH_2$—.

Group Q is preferably a group selected from —$(CH_2)_{2-4}$—, —$CH_2CH(OH)CH_2$—,

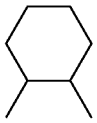

optionally substituted by methyl or ethyl,

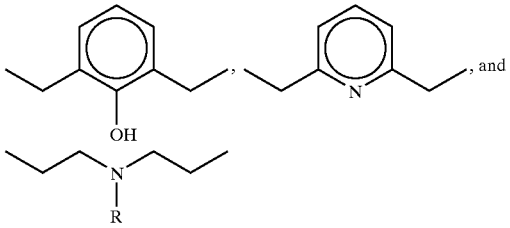

wherein R represents —H or $C_{1-4}$-alkyl.

Preferably, $Q_1$, $Q_2$, $Q_3$, $Q_4$ are defined such that a=b=0, c=1 and n=1, and Q is defined such that a=b=0, c=2 and n=1.

The groups R5, R6, R7, R8 preferably independently represent a group selected from —H, hydroxy-$C_0$–$C_{20}$-alkyl, halo-$C_0$–$C_{20}$-alkyl, nitroso, formyl-$C_0$–$C_{20}$-alkyl, carboxyl-$C_0$–$C_{20}$-alkyl and esters and salts thereof, carbamoyl-$C_0$–$C_{20}$-alkyl, sulfo-$C_0$–$C_{20}$-alkyl and esters and salts thereof, sulfamoyl-$C_0$–$C_{20}$-alkyl, amino-$C_0$–$C_{20}$-alkyl, aryl-$C_0$–$C_{20}$-alkyl, $C_0$–$C_{20}$-alkyl, alkoxy-$C_0$–$C_8$-alkyl, carbonyl-$C_0$–$C_6$-alkoxy, and $C_0$–$C_{20}$-alkylamide. Preferably, none of R5–R8 is linked together.

In a preferred aspect, the ligand is of the general formula (IIB):

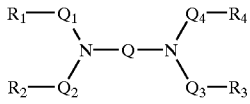

(IIB)

wherein $Q_1$, $Q_2$, $Q_3$, $Q_4$ are defined such that a=b=0, c=1 or 2 and n=1;

Q is defined such that a=b=0, c=2,3 or 4 and n=1; and $R_1$, $R_2$, $R_3$, $R_4$, R7, R8 are independently defined as for formula (I).

Preferred classes of ligands according to this aspect, as represented by formula (IIB) above, are as follows:

(i) ligands of the general formula (IIB) wherein:

$R_1$, $R_2$, $R_3$, $R_4$ each independently represent a coordinating group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole.

In this class, we prefer that:

Q is defined such that a=b=0, c=2 or 3 and n=1;

$R_1$, $R_2$, $R_3$, $R_4$ each independently represent a coordinating group selected from optionally substituted pyridin-2-yl, optionally substituted imidazol-2-yl, optionally substituted imidazol-4-yl, optionally substituted pyrazol-1-yl, and optionally substituted quinolin-2-yl.

(ii) ligands of the general formula (IIB) wherein:

$R_1$, $R_2$, $R_3$ each independently represent a coordinating group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole; and $R_4$ represents a group selected from hydrogen, $C_{1-20}$ optionally substituted alkyl, $C_{1-20}$ optionally substituted arylalkyl, aryl, and $C_{1-20}$ optionally substituted $NR_3^+$ (wherein R=$C_{1-8}$-alkyl).

In this class, we prefer that:

Q is defined such that a=b=0, c=2 or 3 and n=1;

$R_1$, $R_2$, $R_3$ each independently represent a coordinating group selected from optionally substituted pyridin-2-yl, optionally substituted imidazol-2-yl, optionally substituted imidazol-4-yl, optionally substituted pyrazol-1-yl, and optionally substituted quinolin-2-yl; and $R_4$ represents a group selected from hydrogen, $C_{1-10}$ optionally substituted alkyl, $C_{1-5}$-furanyl, $C_{1-5}$ optionally substituted benzylalkyl, benzyl, $C_{1-5}$ optionally substituted alkoxy, and $C_{1-20}$ optionally substituted $N^+Me_3$.

(iii) ligands of the general formula (IIB) wherein:

$R_1$, $R_4$ each independently represent a coordinating group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole; and $R_2$, $R_3$ each independently represent a group selected from hydrogen, $C_{1-20}$ optionally substituted alkyl, $C_{1-20}$ optionally substituted arylalkyl, aryl, and $C_{1-20}$ optionally substituted $NR_3^+$ (wherein R=$C_{1-8}$-alkyl).

In this class, we prefer that:

Q is defined such that a=b=0, c=2 or 3 and n=1;

$R_1$, $R_4$ each independently represent a coordinating group selected from optionally substituted pyridin-2-yl, optionally substituted imidazol-2-yl, optionally substituted imidazol-4-yl, optionally substituted pyrazol-1-yl, and optionally substituted quinolin-2-yl; and $R_2$, $R_3$ each independently represent a group selected from hydrogen, $C_{1-10}$ optionally substituted alkyl, $C_{1-5}$-furanyl, $C_{1-5}$ optionally substituted benzylalkyl, benzyl, $C_{1-5}$ optionally substituted alkoxy, and $C_{1-20}$ optionally substituted $N^+Me_3$.

Examples of preferred ligands in their simplest forms are:

N,N',N'-tris(3-methyl-pyridin-2-ylmethyl)-ethylenediamine; N-trimethylammoniumpropyl-N,N',N'-tris(pyridin-2-ylmethyl)-ethylenediamine;

N-(2-hydroxyethylene)-N,N',N'-tris(pyridin-2-ylmethyl)-ethylenediamine;

N,N,N',N'-tetrakis(3-methyl-pyridin-2-ylmethyl)-ethylene-diamine;

N,N'-dimethyl-N,N'-bis(pyridin-2-ylmethyl)-cyclohexane-1,2-diamine;

N-(2-hydroxyethylene)-N,N',N'-tris(3-methyl-pyridin-2-ylmethyl)-ethylenediamine;

N-methyl-N,N',N'-tris(pyridin-2-ylmethyl)-ethylenediamine;

N-methyl-N,N',N'-tris(5-ethyl-pyridin-2-ylmethyl)-ethylenediamine;

N-methyl-N,N',N'-tris(5-methyl-pyridin-2-ylmethyl)-ethylenediamine;

N-methyl-N,N',N'-tris(3-methyl-pyridin-2-ylmethyl)-ethylenediamine;

N-benzyl-N,N',N'-tris(3-methyl-pyridin-2-ylmethyl)-ethylenediamine;

N-ethyl-N,N',N'-tris(3-methyl-pyridin-2-ylmethyl)-ethylenediamine;

N,N,N'-tris(3-methyl-pyridin-2-ylmethyl)-N' (2'-methoxyethyl-1)-ethylenediamine;

N,N,N'-tris(1-methyl-benzimidazol-2-yl)-N'-methyl-ethylenediamine;

N-(furan-2-yl)-N,N',N'-tris(3-methyl-pyridin-2-ylmethyl)-ethylenediamine;

N-(2-hydroxyethylene)-N,N',N'-tris(3-ethyl-pyridin-2-ylmethyl)-ethylenediamine;

N-methyl-N,N',N'-tris(3-methyl-pyridin-2-ylmethyl) ethylene-1,2-diamine;

N-ethyl-N,N',N'-tris(3-methyl-pyridin-2-ylmethyl) ethylene-1,2-diamine;

N-benzyl-N,N',N'-tris(3-methyl-pyridin-2-ylmethyl) ethylene-1,2-diamine;

N-(2-hydroxyethyl)-N,N',N'-tris(3-methyl-pyridin-2-ylmethyl)ethylene-1,2-diamine;

N-(2-methoxyethyl)-N,N',N'-tris(3-methyl-pyridin-2-ylmethyl)ethylene-1,2-diamine;

N-methyl-N,N',N'-tris(5-methyl-pyridin-2-ylmethyl) ethylene-1,2-diamine;

N-ethyl-N,N',N'-tris(5-methyl-pyridin-2-ylmethyl) ethylene-1,2-diamine;

N-benzyl-N,N',N'-tris(5-methyl-pyridin-2-ylmethyl) ethylene-1,2-diamine;

N-(2-hydroxyethyl)-N,N',N'-tris(5-methyl-pyridin-2-ylmethyl)ethylene-1,2-diamine;

N-(2-methoxyethyl)-N,N',N'-tris(5-methyl-pyridin-2-ylmethyl)ethylene-1,2-diamine;

N-methyl-N,N',N'-tris(3-ethyl-pyridin-2-ylmethyl) ethylene-1,2-diamine;

N-ethyl-N,N',N'-tris(3-ethyl-pyridin-2-ylmethyl) ethylene-1,2-diamine;

N-benzyl-N,N',N'-tris(3-ethyl-pyridin-2-ylmethyl) ethylene-1,2-diamine;

N-(2-hydroxyethyl)-N,N',N'-tris(3-ethyl-pyridin-2-ylmethyl)ethylene-1,2-diamine;

N-(2-methoxyethyl)-N,N',N'-tris(3-ethyl-pyridin-2-ylmethyl)ethylene-1,2-diamine;

N-methyl-N,N',N'-tris(5-ethyl-pyridin-2-ylmethyl) ethylene-1,2-diamine;

N-ethyl-N,N',N'-tris(5-ethyl-pyridin-2-ylmethyl) ethylene-1,2-diamine;

N-benzyl-N,N',N'-tris(5-ethyl-pyridin-2-ylmethyl) ethylene-1,2-diamine; and

N-(2-methoxyethyl)-N,N',N'-tris(5-ethyl-pyridin-2-ylmethyl)ethylene-1,2-diamine.

More preferred ligands are:

N-methyl-N,N',N'-tris(3-methyl-pyridin-2-ylmethyl) ethylene-1,2-diamine;

N-ethyl-N,N',N'-tris(3-methyl-pyridin-2-ylmethyl) ethylene-1,2-diamine;

N-benzyl-N,N',N'-tris(3-methyl-pyridin-2-ylmethyl) ethylene-1,2-diamine;

N-(2-hydroxyethyl)-N,N',N'-tris(3-methyl-pyridin-2-ylmethyl)ethylene-1,2-diamine; and N-(2-methoxyethyl)-N,N',N'-tris(3-methyl-pyridin-2-ylmethyl)ethylene-1,2-diamine.

(C) Ligands of the general formula (IC):

(IC)

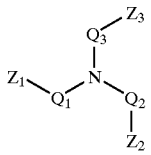

wherein $Z_1$, $Z_2$ and $Z_3$ independently represent a coordinating group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole;

$Q_1$, $Q_2$, and $Q_3$ independently represent a group of the formula:

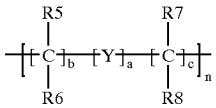

wherein $5 \geqq a+b+c \geqq 1$; a=0–5; b=0–5; c=0–5; n=1 or 2;

Y independently represents a group selected from —O—, —S—, —SO—, —$SO_2$—, —C(O)—, arylene, alkylene, heteroarylene, heterocycloalkylene, —(G)P—, —P(O)— and —(G)N—, wherein G is selected from hydrogen, alkyl, aryl, arylalkyl, cycloalkyl, each except hydrogen being optionally substituted by one or more functional groups E; and R5, R6, R7, R8 independently represent a group selected from hydrogen, hydroxyl, halogen, —R and —OR, wherein R represents alkyl, alkenyl, cycloalkyl, heterocycloalkyl, aryl, heteroaryl or a carbonyl derivative group, R being optionally substituted by one or more functional groups E, or R5 together with R6, or R7 together with R8, or both, represent oxygen, or R5 together with R7 and/or independently R6 together with R8, or R5 together with R8 and/or independently R6 together with R7, represent $C_{1-6}$-alkylene optionally substituted by $C_{1-4}$-alkyl, —F, —Cl, —Br or —I.

$Z_1$, $Z_2$ and $Z_3$ each represent a coordinating group, preferably selected from optionally substituted pyridin-2-yl, optionally substituted imidazol-2-yl, optionally substituted imidazol-4-yl, optionally substituted pyrazol-1-yl, and optionally substituted quinolin-2-yl. Preferably, $Z_1$, $Z_2$ and $Z_3$ each represent optionally substituted pyridin-2-yl.

Optional substituents for the groups $Z_1$, $Z_2$ and $Z_3$ are preferably selected from $C_{1-4}$-alkyl, aryl, arylalkyl, heteroaryl, methoxy, hydroxy, nitro, amino, carboxyl, halo, and carbonyl, preferably methyl.

Also preferred is that $Q_1$, $Q_2$ and $Q_3$ are defined such that a=b=0, c=1 or 2, and n=1.

Preferably, each $Q_1$, $Q_2$ and $Q_3$ independently represent $C_{1-4}$-alkylene, more preferably a group selected from —$CH_2$— and —$CH_2CH_2$—.

The groups R5, R6, R7, R8 preferably independently represent a group selected from —H, hydroxy-$C_0$–$C_{20}$-alkyl, halo-$C_0$–$C_{20}$-alkyl, nitroso, formyl-$C_0$–$C_{20}$-alkyl, carboxyl-$C_0$–$C_{20}$-alkyl and esters and salts thereof, carbamoyl-$C_0$–$C_{20}$-alkyl, sulfo-$C_0$–$C_{20}$-alkyl and esters and salts thereof, sulfamoyl-$C_0$–$C_{20}$-alkyl, amino-$C_0$–$C_{20}$-alkyl, aryl-$C_0$–$C_{20}$-alkyl, $C_0$–$C_{20}$-alkyl, alkoxy-$C_0$–$C_8$-alkyl, carbonyl-$C_0$–$C_6$-alkoxy, and $C_0$–$C_{20}$-alkylamide. Preferably, none of R5–R8 is linked together.

Preferably, the ligand is selected from tris(pyridin-2-ylmethyl)amine, tris(3-methylpyridin-2-ylmethyl)amine, tris(5-methyl-pyridin-2-ylmethyl)amine, and tris(6-methyl-pyridin-2-ylmethyl)amine.

(D) Ligands of the general formula (ID):

(ID)

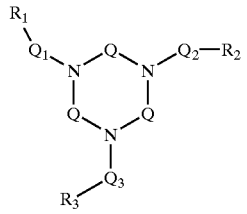

wherein $R_1$, $R_2$, and $R_3$ independently represent a group selected from hydrogen, hydroxyl, halogen, —NH—C(NH)$NH_2$, —R and —OR, wherein R=alkyl, alkenyl, cycloalkyl, heterocycloalkyl, aryl, heteroaryl or a carbonyl derivative group, R being optionally substituted by one or more functional groups E;

Q independently represent a group selected from $C_{2-3}$-alkylene optionally substituted by H, benzyl or $C_{1-8}$-alkyl;

$Q_1$, $Q_2$ and $Q_3$ independently represent a group of the formula:

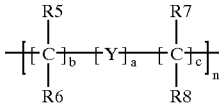

wherein $5 \geqq a+b+c \geqq 1$; a=0–5; b=0–5; c=0–5; n=1 or 2;

Y independently represents a group selected from —O—, —S—, —SO—, —$SO_2$—, —C(O)—, arylene, alkylene, heteroarylene, heterocycloalkylene, —(G)P—, —P(O)— and —(G)N—, wherein G is selected from hydrogen, alkyl, aryl, arylalkyl, cycloalkyl, each except hydrogen being optionally substituted by one or more functional groups E; and R5, R6, R7, R8 independently represent a group selected from hydrogen, hydroxyl, halogen, —R and —OR, wherein R represents alkyl, alkenyl, cycloalkyl, heterocycloalkyl, aryl, heteroaryl or a carbonyl derivative group, R being optionally substituted by one or more functional groups E, or R5 together with R6, or R7 together with R8, or both, represent oxygen, or R5 together with R7 and/or independently R6 together with R8, or R5 together with R8 and/or independently R6 together with R7, represent $C_{1-6}$-alkylene optionally substituted by $C_{1-4}$-alkyl, —F, —Cl, —Br or —I, provided that at least one, preferably at least two, of $R_1$, $R_2$ and $R_3$ is a coordinating group.

At least two, and preferably at least three, of $R_1$, $R_2$ and $R_3$ independently represent a group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole. Preferably, at least two of $R_1$, $R_2$, $R_3$ each independently represent a coordinating group selected from optionally substituted pyridin-2-yl, optionally substituted imidazol-2-yl, optionally substituted imidazol-4-yl, optionally substituted pyrazol-1-yl, and optionally substituted quinolin-2-yl.

Preferably, substituents for groups $R_1$, $R_2$, $R_3$, when representing a heterocyclic or heteroaromatic ring, are selected from $C_{1-4}$-alkyl, aryl, arylalkyl, heteroaryl, methoxy, hydroxy, nitro, amino, carboxyl, halo, and carbonyl.

Preferably, $Q_1$, $Q_2$ and $Q_3$ are defined such that a=b=0, c=1,2,3 or 4 and n=1. Preferably, the groups $Q_1$, $Q_2$ and $Q_3$ independently represent a group selected from —$CH_2$— and —$CH_2CH_2$-.

Group Q is preferably a group selected from —$CH_2CH_2$— and —$CH_2CH_2CH_2$—.

The groups R5, R6, R7, R8 preferably independently represent a group selected from —H, hydroxy-$C_0$–$C_{20}$-alkyl, halo-$C_0$–$C_{20}$-alkyl, nitroso, formyl-$C_0$–$C_{20}$-alkyl, carboxyl-$C_0$–$C_{20}$-alkyl and esters and salts thereof, carbamoyl-$C_0$–$C_{20}$-alkyl, sulfo-$C_0$–$C_{20}$-alkyl and esters and salts thereof, sulfamoyl-$C_0$–$C_{20}$-alkyl, amino-$C_0$–$C_{20}$-alkyl, aryl-$C_0$–$C_{20}$-alkyl, $C_0$–$C_{20}$-alkyl, alkoxy-$C_0$–$C_8$-alkyl, carbonyl-$C_0$–$C_6$-alkoxy, and $C_0$–$C_{20}$-alkylamide. Preferably, none of R5–R8 is linked together.

In a preferred aspect, the ligand is of the general formula (IID):

(IID)

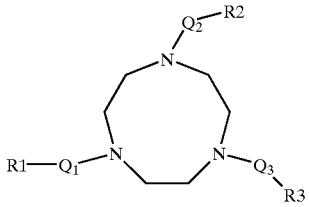

wherein R1, R2, R3 are as defined previously for $R_1$, $R_2$, $R_3$, and $Q_1$, $Q_2$, $Q_3$ are as defined previously.

Preferred classes of ligands according to this preferred aspect, as represented by formula (IID) above, are as follows:

(i) ligands of the general formula (IID) wherein:

R1, R2, R3 each independently represent a coordinating group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole.

In this class, we prefer that:

R1, R2, R3 each independently represent a coordinating group selected from optionally substituted pyridin-2-yl, optionally substituted imidazol-2-yl, optionally substituted imidazol-4-yl, optionally substituted pyrazol-1-yl, and optionally substituted quinolin-2-yl. (ii) ligands of the general formula (IID) wherein:

two of R1, R2, R3 each independently represent a coordinating group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole; and one of R1, R2, R3 represents a group selected from hydrogen, $C_{1-20}$ optionally substituted alkyl, $C_{1-20}$ optionally substituted arylalkyl, aryl, and $C_{1-20}$ optionally substituted $NR_3^+$ (wherein R=$C_{1-8}$-alkyl).

In this class, we prefer that:

two of R1, R2, R3 each independently represent a coordinating group selected from optionally substituted pyridin-2-yl, optionally substituted imidazol-2-yl, optionally substituted imidazol-4-yl, optionally substituted pyrazol-1-yl, and optionally substituted quinolin-2-yl; and one of R1, R2, R3 represents a group selected from hydrogen, $C_{1-10}$ optionally substituted alkyl, $C_{1-5}$-furanyl, $C_{1-5}$ optionally substituted benzylalkyl, benzyl, $C_{1-5}$ optionally substituted alkoxy, and $C_{1-20}$ optionally substituted $N^+Me_3$.

In especially preferred embodiments, the ligand is selected from:

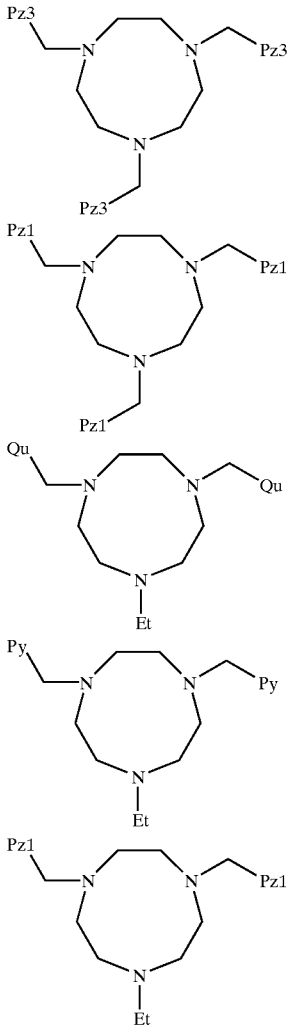

wherein —Et represents ethyl, —Py represents pyridin-2-yl, Pz3 represents pyrazol-3-yl, Pz1 represents pyrazol-1-yl, and Qu represents quinolin-2-yl.

(E) Ligands of the general formula (IE):

(IE)

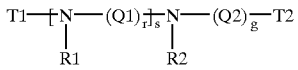

wherein g represents zero or an integer from 1 to 6;

r represents an integer from 1 to 6;

s represents zero or an integer from 1 to 6;

Q1 and Q2 independently represent a group of the formula:

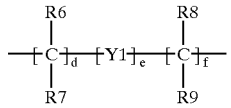

wherein $5 \geqq d+e+f \geqq 1$; d=0–5; e=0–5; f=0–5;

each Y1 independently represents a group selected from —O—, —S—, —SO—, —$SO_2$—, —C(O)—, arylene, alkylene, heteroarylene, heterocycloalkylene, —(G)P—, —P(O)— and —(G)N—, wherein G is selected from hydrogen, alkyl, aryl, arylalkyl, cycloalkyl, each except hydrogen being optionally substituted by one or more functional groups E;

if s>1, each —[—N(R1)—(Q1)$_r$—]— group is independently defined;

R1, R2, R6, R7, R8, R9 independently represent a group selected from hydrogen, hydroxyl, halogen, —R and —OR, wherein R represents alkyl, alkenyl, cycloalkyl, heterocycloalkyl, aryl, heteroaryl or a carbonyl derivative group, R being optionally substituted by one or more functional groups E, or R6 together with R7, or R8 together with R9, or both, represent oxygen, or R6 together with R8 and/or independently R7 together with R9, or R6 together with R9 and/or independently R7 together with R8, represent $C_{1-6}$-alkylene optionally substituted by $C_{1-4}$-alkyl, —F, —Cl, —Br or —I;

or one of R1–R9 is a bridging group bound to another moiety of the same general formula;

T1 and T2 independently represent groups R4 and R5, wherein R4 and R5 are as defined for R1–R9, and if g=0 and s>0, R1 together with R4, and/or R2 together with R5, may optionally independently represent =CH—R10, wherein R10 is as defined for R1–R9, or T1 and T2 may together (-T2-T1-) represent a covalent bond linkage when s>1 and g>0;

if T1 and T2 together represent a single bond linkage, Q1 and/or Q2 may independently represent a group of the formula:=CH—[—Y1—]$_e$—CH=provided R1 and/or R2 are absent, and R1 and/or R2 may be absent provided Q1 and/or $Q_2$ independently represent a group of the formula: =CH—[—Y1—]$_e$—CH=.

The groups R1–R9 are preferably independently selected from —H, hydroxy-$C_0$–$C_{20}$-alkyl, halo-$C_0$–$C_{20}$-alkyl, nitroso, formyl-$C_0$–$C_{20}$-alkyl, carboxyl-$C_0$–$C_{20}$-alkyl and esters and salts thereof, carbamoyl-$C_0$–$C_{20}$-alkyl, sulpho-$C_0$–$C_{20}$-alkyl and esters and salts thereof, sulphamoyl-$C_0$–$C_{20}$-alkyl, amino-$C_0$–$C_{20}$-alkyl, aryl-$C_0$–$C_{20}$-alkyl, heteroaryl-$C_0$–$C_{20}$-alkyl, $C_0$–$C_{20}$-alkyl, alkoxy-$C_0$–$C_8$-alkyl, carbonyl-$C_0$–$C_6$-alkoxy, and aryl-$C_0$–$C_6$-alkyl and $C_0$–$C_{20}$-alkylamide.

One of R1–R9 may be a bridging group which links the ligand moiety to a second ligand moiety of preferably the same general structure. In this case the bridging group is independently defined according to the formula for Q1, Q2, preferably being alkylene or hydroxy-alkylene or a heteroaryl-containing bridge, more preferably $C_{1-6}$-alkylene optionally substituted by $C_{1-4}$-alkyl, —F, —Cl, —Br or —I.

In a first variant according to formula (IE), the groups T1 and T2 together form a single bond linkage and s>1, according to general formula (IIE):

(IIE)

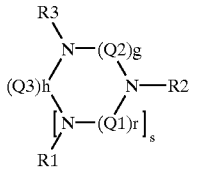

wherein R3 independently represents a group as defined for R1–R9; Q3 independently represents a group as defined for Q1, Q2; h represents zero or an integer from 1 to 6; and s=s−1.

In a first embodiment of the first variant, in general formula (IIE), s=1, 2 or 3; r=g=h=1; d=2 or 3; e=f=0; R6=R7=H, preferably such that the ligand has a general formula selected from:

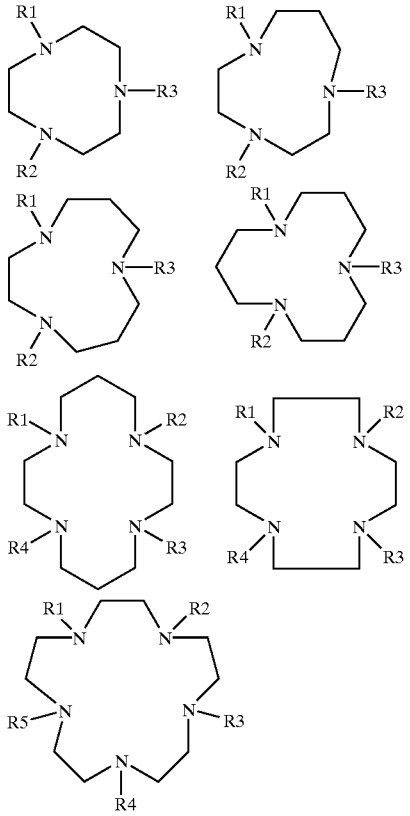

In these preferred examples, R1, R2, R3 and R4 are preferably independently selected from —H, alkyl, aryl, heteroaryl, and/or one of R1–R4 represents a bridging group bound to another moiety of the same general formula and/or two or more of R1–R4 together represent a bridging group linking N atoms in the same moiety, with the bridging group being alkylene or hydroxy-alkylene or a heteroaryl-containing bridge, preferably heteroarylene. More preferably, R1, R2, R3 and R4 are independently selected from —H, methyl, ethyl, isopropyl, nitrogen-containing heteroaryl, or a bridging group bound to another moiety of the same general formula or linking N atoms in the same moiety with the bridging group being alkylene or hydroxy-alkylene.

In a second embodiment of the first variant, in general formula (IIE), s=2 and r=g=h=1, according to the general formula:

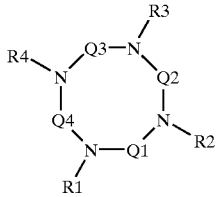

In this second embodiment, preferably R1–R4 are absent; both Q1and Q3 represent =CH—[—Y1—]$_e$—CH=; and both Q2 and Q4 represent —$CH_2$—[—Y1—]$_n$—$CH_2$—.

Thus, preferably the ligand has the general formula:

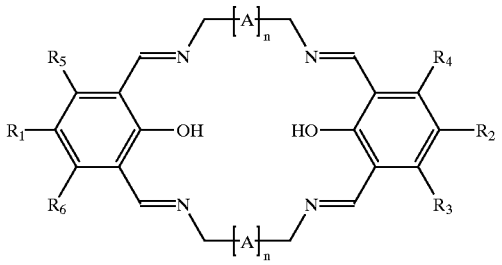

wherein A represents optionally substituted alkylene optionally interrupted by a heteroatom; and n is zero or an integer from 1 to 5.

Preferably, R1–R6 represent hydrogen, n=1 and A=—$CH_2$—, —CHOH—, —$CH_2N(R)CH_2$— or —$CH_2CH_2N(R)CH_2CH_2$— wherein R represents hydrogen or alkyl, more preferably A=—$CH_2$—, —CHOH— or —$CH_2CH_2NHCH_2CH_2$—.

In a second variant according to formula (IE), T1 and T2 independently represent groups R4, R5 as defined for R1–R9, according to the general formula (IIIE):

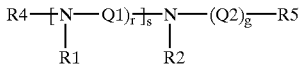

(IIIE)

In a first embodiment of the second variant, in general formula (IIIE), s=1; r=1; g=0; d=f=1; e=0–4; Y1=—$CH_2$—; and R1 together with R4, and/or R2 together with R5, independently represent =CH—R10, wherein R10 is as defined for R1–R9. In one example, R2 together with R5 represents =CH—R10, with R1 and R4 being two separate groups. Alternatively, both R1 together with R4, and R2 together with R5 may independently represent =CH—R10. Thus, preferred ligands may for example have a structure selected from:

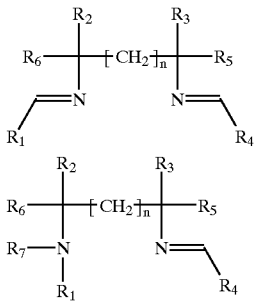

wherein n=0–4.

Preferably, the ligand is selected from:

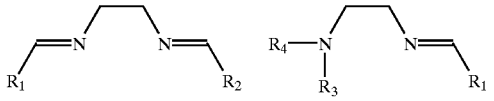

wherein R1and R2 are selected from optionally substituted phenols, heteroaryl-$C_0$–$C_{20}$-alkyls, R3 and R4 are selected from —H, alkyl, aryl, optionally substituted phenols, heteroaryl-$C_0$–$C_{20}$-alkyls, alkylaryl, aminoalkyl, alkoxy, more preferably R1 and R2 being selected from optionally substituted phenols, heteroaryl-$C_0$–$C_2$-alkyls, R3 and R4 are selected from —H, alkyl, aryl, optionally substituted phenols, nitrogen-heteroaryl-$C_0$–$C_2$-alkyls.

In a second embodiment of the second variant, in general formula (IIIE), s=1; r=1; g=0; d=f=1; e=1–4; Y1=—C(R')(R"), wherein R' and R" are independently as defined for R1–R9. Preferably, the ligand has the general formula:

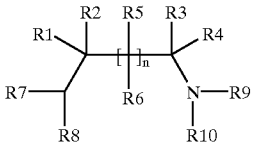

The groups R1, R2, R3, R4, R5 in this formula are preferably —H or $C_0$–$C_{20}$-alkyl, n=0 or 1, R6 is —H, alkyl, —OH or —SH, and R7, R8, R9, R10 are preferably each independently selected from —H, $C_0$–$C_{20}$-alkyl, heteroaryl-$C_0$–$C_{20}$-alkyl, alkoxy-$C_0$–$C_8$-alkyl and amino-$C_0$–$C_{20}$-alkyl.

In a third embodiment of the second variant, in general formula (IIIE), s=0; g=1; d=e=0; f=1–4. Preferably, the ligand has the general formula:

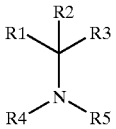

This class of ligand is particularly preferred according to the invention.

More preferably, the ligand has the general formula:

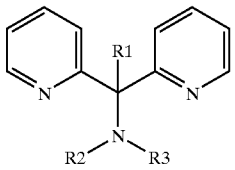

wherein R1, R2, R3 are as defined for R2, R4, R5.

In a fourth embodiment of the second variant, the ligand is a pentadentate ligand of the general formula (IVE):

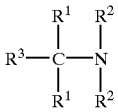

(IVE)

wherein each $R^1$, $R^2$ independently represents —$R^4$–$R^5$, $R^3$ represents hydrogen, optionally substituted alkyl, aryl or arylalkyl, or —$R^4$–$R^5$, each $R^4$ independently represents a single bond or optionally substituted alkylene, alkenylene, oxyalkylene, aminoalkylene, alkylene ether, carboxylic ester or carboxylic amide, and each $R^5$ independently represents an optionally N-substituted aminoalkyl group or an optionally substituted heteroaryl group selected from pyridinyl, pyrazinyl, pyrazolyl, pyrrolyl, imidazolyl, benzimidazolyl, pyrimidinyl, triazolyl and thiazolyl.

Ligands of the class represented by general formula (IVE) are also particularly preferred according to the invention. The ligand having the general formula (IVE), as defined above, is a pentadentate ligand. By 'pentadentate' herein is meant that five hetero atoms can coordinate to the metal M ion in the metal-complex.

In formula (IVE), one coordinating hetero atom is provided by the nitrogen atom in the methylamine backbone, and preferably one coordinating hetero atom is contained in each of the four $R^1$ and $R^2$ side groups. Preferably, all the coordinating hetero atoms are nitrogen atoms.

The ligand of formula (IVE) preferably comprises at least two substituted or unsubstituted heteroaryl groups in the four side groups. The heteroaryl group is preferably a pyridin-2-yl group and, if substituted, preferably a methyl- or ethyl-substituted pyridin-2-yl group. More preferably, the heteroaryl group is an unsubstituted pyridin-2-yl group. Preferably, the heteroaryl group is linked to methylamine, and preferably to the N atom thereof, via a methylene group. Preferably, the ligand of formula (IVE) contains at least one optionally substituted amino-alkyl side group, more preferably two amino-ethyl side groups, in particular 2-(N-alkyl) amino-ethyl or 2-(N,N-dialkyl)amino-ethyl.

Thus, in formula (IVE) preferably $R^1$ represents pyridin-2-yl or $R_2$ represents pyridin-2-yl-methyl. Preferably $R^2$ or $R_1$ represents 2-amino-ethyl, 2-(N-(m)ethyl)amino-ethyl or 2-(N,N-di(m)ethyl)amino-ethyl. If substituted, $R^5$ preferably represents 3-methyl pyridin-2-yl. $R^3$ preferably represents hydrogen, benzyl or methyl.

Examples of preferred ligands of formula (IVE) in their simplest forms are:

(i) pyridin-2-yl containing ligands such as:

N,N-bis(pyridin-2-yl-methyl)-bis(pyridin-2-yl) methylamine;

N,N-bis(pyrazol-1-yl-methyl)-bis(pyridin-2-yl) methylamine;

N,N-bis(imidazol-2-yl-methyl)-bis(pyridin-2-yl) methylamine;

N,N-bis(1,2,4-triazol-1-yl-methyl)-bis(pyridin-2-yl) methylamine;

N,N-bis(pyridin-2-yl-methyl)-bis(pyrazol-1-yl) methylamine;

N,N-bis(pyridin-2-yl-methyl)-bis(imidazol-2-yl) methylamine;

N,N-bis(pyridin-2-yl-methyl)-bis(1,2,4-triazol-1-yl) methylamine;

N,N-bis(pyridin-2-yl-methyl)-1,1-bis(pyridin-2-yl)-1-aminoethane;

N,N-bis(pyridin-2-yl-methyl)-1,1-bis(pyridin-2-yl)-2-phenyl-1-aminoethane;

N,N-bis(pyrazol-1-yl-methyl)-1,1-bis(pyridin-2-yl)-1-aminoethane;

N,N-bis(pyrazol-1-yl-methyl)-1,1-bis(pyridin-2-yl)-2-phenyl-1-aminoethane;

N,N-bis(imidazol-2-yl-methyl)-1,1-bis(pyridin-2-yl)-1-aminoethane;

N,N-bis(imidazol-2-yl-methyl)-1,1-bis(pyridin-2-yl)-2-phenyl-1-aminoethane;

N,N-bis(1,2,4-triazol-1-yl-methyl)-1,1-bis(pyridin-2-yl)-1-aminoethane;

N,N-bis(1,2,4-triazol-1-yl-methyl)-1,1-bis(pyridin-2-yl)-2-phenyl-1-aminoethane;

N,N-bis(pyridin-2-yl-methyl)-1,1-bis(pyrazol-1-yl)-1-aminoethane;

N,N-bis(pyridin-2-yl-methyl)-1,1-bis(pyrazol-1-yl)-2-phenyl-1-aminoethane;

N,N-bis(pyridin-2-yl-methyl)-1,1-bis(imidazol-2-yl)-1-aminoethane;

N,N-bis(pyridin-2-yl-methyl)-1,1-bis(imidazol-2-yl)-2-phenyl-1-aminoethane;

N,N-bis(pyridin-2-yl-methyl)-1,1-bis(1,2,4-triazol-1-yl)-1-aminoethane;

N,N-bis(pyridin-2-yl-methyl)-1,1-bis(1,2,4-triazol-1-yl)-1-aminoethane;

N,N-bis(pyridin-2-yl-methyl)-1,1-bis(pyridin-2-yl)-1-aminoethane;

N,N-bis(pyridin-2-yl-methyl)-1,1-bis(pyridin-2-yl)-1-aminohexane;

N,N-bis(pyridin-2-yl-methyl)-1,1-bis(pyridin-2-yl)-2-phenyl-1-aminoethane;

N,N-bis(pyridin-2-yl-methyl)-1,1-bis(pyridin-2-yl)-2-(4-sulphonic acid-phenyl)-1-aminoethane;

N,N-bis(pyridin-2-yl-methyl)-1,1-bis(pyridin-2-yl)-2-(pyridin-2-yl)-1-aminoethane;

N,N-bis(pyridin-2-yl-methyl)-1,1-bis(pyridin-2-yl)-2-(pyridin-3-yl)-1-aminoethane;

N,N-bis(pyridin-2-yl-methyl)-1,1-bis(pyridin-2-yl)-2-(pyridin-4-yl)-1-aminoethane;

N,N-bis(pyridin-2-yl-methyl)-1,1-bis(pyridin-2-yl)-2-(1-alkyl-pyridinium-4-yl)-1-aminoethane;

N,N-bis(pyridin-2-yl-methyl)-1,1-bis(pyridin-2-yl)-2-(1-alkyl-pyridinium-3-yl)-1-aminoethane;

N,N-bis(pyridin-2-yl-methyl)-1,1-bis(pyridin-2-yl)-2-(1-alkyl-pyridinium-2-yl)-1-aminoethane;

(ii) 2-amino-ethyl containing ligands such as:

N,N-bis(2-(N-alkyl)amino-ethyl)-bis(pyridin-2-yl) methylamine;

N,N-bis(2-(N-alkyl)amino-ethyl)-bis(pyrazol-1-yl) methylamine;

N,N-bis(2-(N-alkyl)amino-ethyl)-bis(imidazol-2-yl) methylamine;

N,N-bis(2-(N-alkyl)amino-ethyl)-bis(1,2,4-triazol-1-yl) methylamine;

N,N-bis(2-(N,N-dialkyl)amino-ethyl)-bis(pyridin-2-yl) methylamine;

N,N-bis(2-(N,N-dialkyl)amino-ethyl)-bis(pyrazol-1-yl) methylamine;

N,N-bis(2-(N,N-dialkyl)amino-ethyl)-bis(imidazol-2-yl) methylamine;

N,N-bis(2-(N,N-dialkyl)amino-ethyl)-bis(1,2,4-triazol-1-yl)methylamine;

N,N-bis(pyridin-2-yl-methyl)-bis(2-amino-ethyl) methylamine;

N,N-bis(pyrazol-1-yl-methyl)-bis(2-amino-ethyl) methylamine;

N,N-bis(imidazol-2-yl-methyl)-bis(2-amino-ethyl) methylamine;

N,N-bis(1,2,4-triazol-1-yl-methyl)-bis(2-amino-ethyl) methylamine.

More preferred ligands are:

N,N-bis(pyridin-2-yl-methyl)-bis(pyridin-2-yl) methylamine, hereafter referred to as N4Py.

N,N-bis(pyridin-2-yl-methyl)-1,1-bis(pyridin-2-yl)-1-aminoethane, hereafter referred to as MeN4Py, N,N-bis(pyridin-2-yl-methyl)-1,1-bis(pyridin-2-yl)-2-phenyl-1-aminoethane, hereafter referred to as BzN4Py.

In a fifth embodiment of the second variant, the ligand represents a pentadentate or hexadentate ligand of general formula (VE):

$$R^1R^1N—W—NR^1R^2 \quad (VE)$$

wherein each $R^1$ independently represents —$R^3$—V, in which $R^3$ represents optionally substituted alkylene, alkenylene, oxyalkylene, aminoalkylene or alkylene ether, and V represents an optionally substituted heteroaryl group selected from pyridinyl, pyrazinyl, pyrazolyl, pyrrolyl, imidazolyl, benzimidazolyl, pyrimidinyl, triazolyl and thiazolyl;

W represents an optionally substituted alkylene bridging group selected from —$CH_2CH_2$—, —$CH_2CH_2CH_2$—, —$CH_2CH_2CH_2CH_2$—, —$CH_2$—$C_6H_4$—$CH_2$—, $CH_2$—, and —$CH_2$—$C_{10}H_6$—$CH_2$—; and $R^2$ represents a group selected from $R^1$, and alkyl, aryl and arylalkyl groups optionally substituted with a substituent selected from hydroxy, alkoxy, phenoxy, carboxylate, carboxamide, carboxylic ester, sulphonate, amine, alkylamine and $N^+(R^4)_3$, wherein $R^4$ is selected from hydrogen, alkanyl, alkenyl, arylalkanyl, arylalkenyl, oxyalkanyl, oxyalkenyl, aminoalkanyl, aminoalkenyl, alkanyl ether and alkenyl ether.

The ligand having the general formula (VE), as defined above, is a pentadentate ligand or, if $R^1$=$R^2$, can be a hexadentate ligand. As mentioned above, by 'pentadentate' is meant that five hetero atoms can coordinate to the metal M ion in the metal-complex. Similarly, by 'hexadentate' is meant that six hetero atoms can in principle coordinate to the metal M ion. However, in this case it is believed that one of the arms will not be bound in the complex, so that the hexadentate ligand will be penta coordinating.

In the formula (VE), two hetero atoms are linked by the bridging group W and one coordinating hetero atom is contained in each of the three $R^1$ groups. Preferably, the coordinating hetero atoms are nitrogen atoms.

The ligand of formula (VE) comprises at least one optionally substituted heteroaryl group in each of the three $R^1$ groups. Preferably, the heteroaryl group is a pyridin-2-yl group, in particular a methyl- or ethyl-substituted pyridin-2-yl group. The heteroaryl group is linked to an N atom in formula (VE), preferably via an alkylene group, more preferably a methylene group. Most preferably, the heteroaryl group is a 3-methyl-pyridin-2-yl group linked to an N atom via methylene.

The group $R^2$ in formula (VE) is a substituted or unsubstituted alkyl, aryl or arylalkyl group, or a group $R^1$. However, preferably $R^2$ is different from each of the groups $R^1$ in the formula above. Preferably, $R^2$ is methyl, ethyl, benzyl, 2-hydroxyethyl or 2-methoxyethyl. More preferably, $R^2$ is methyl or ethyl.

The bridging group W may be a substituted or unsubstituted alkylene group selected from —$CH_2CH_2$—, —$CH_2CH_2CH_2$—, —$CH_2CH_2CH$—$_2CH_2$—, —$CH_2$—$C_6H_4$—$CH_2$—, —$CH_2$—$C_6H_{10}$—$CH_2$—, and —$CH_2$—$C_{10}H_6$—$CH_2$— (wherein —$C_6H_4$—, —$C_6H_{10}$—, —$C_{10}H_6$— can be ortho-, para-, or meta-$C_6H_4$—, —$C_6H_{10}$—, —$C_{10}H_6$—). Preferably, the bridging group W is an ethylene or 1,4-butylene group, more preferably an ethylene group.

Preferably, V represents substituted pyridin-2-yl, especially methyl-substituted or ethyl-substituted pyridin-2-yl, and most preferably V represents 3-methyl pyridin-2-yl.

(F) Ligands of the classes disclosed in WO-A-98/39098 and WO-A-98/39406.

The counter ions Y in formula (A1) balance the charge z on the complex formed by the ligand L, metal M and coordinating species X. Thus, if the charge z is positive, Y may be an anion such as $RCOO^-$, $BPh_4^-$, $ClO_4^-$, $BF_4^-$, $PF_6^-$, $RSO_3^-$, $RSO_4^-$, $SO_4^{2-}$, $NO_3^-$, $F^-$, $Cl^-$, $Br^-$, or $I^-$, with R being hydrogen, optionally substituted alkyl or optionally substituted aryl. If z is negative, Y may be a common cation such as an alkali metal, alkaline earth metal or (alkyl) ammonium cation.

Suitable counter ions Y include those which give rise to the formation of storage-stable solids. Preferred counter ions for the preferred metal complexes are selected from $R^7COO^-$, $ClO_4^-$, $BF_4^-$, $PF_6^-$, $RSO_3^-$ (in particular $CF_3SO_3^-$), $RSO_4^-$, $SO_4^{2-}$, $NO_3^-$, $F^-$, $Cl^-$, $Br^-$, and $I^-$, wherein R represents hydrogen or optionally substituted phenyl, naphthyl or $C_1$–$C_4$ alkyl.

It will be appreciated that the complex (A1) can be formed by any appropriate means, including in situ formation whereby precursors of the complex are transformed into the active complex of general formula (A1) under conditions of storage or use. Preferably, the complex is formed as a well-defined complex or in a solvent mixture comprising a salt of the metal M and the ligand L or ligand L-generating species. Alternatively, the catalyst may be formed in situ from suitable precursors for the complex, for example in a solution or dispersion containing the precursor materials. In one such example, the active catalyst may be formed in situ in a mixture comprising a salt of the metal M and the ligand L, or a ligand L-generating species, in a suitable solvent. Thus, for example, if M is iron, an iron salt such as $FeSO_4$ can be mixed in solution with the ligand L, or a ligand L-generating species, to form the active complex. Thus, for example, the composition may formed from a mixture of the ligand L and a metal salt $MX_n$ in which preferably n=1–5, more preferably 1–3. In another such example, the ligand L, or a ligand L-generating species, can be mixed with metal M ions present in the substrate or wash liquor to form the active catalyst in situ. Suitable ligand L-generating species include metal-free compounds or metal coordination complexes that comprise the ligand L and can be substituted by metal M ions to form the active complex according the formula (A1).

In typical washing compositions the level of the catalyst is such that the in-use level is from 1 $\mu$M to 50 mM, with preferred in-use levels for domestic laundry operations falling in the range 10 to 100 $\mu$M.

Preferably, the pretreatment medium or wash liquor has a pH in the range from pH 6 to 13, more preferably from pH 6 to 11, still more preferably from pH 8 to 11, and most preferably from pH 8 to 10, in particular from pH 9 to 10.

In the context of the present invention bleaching should be understood as relating generally to the decolourisation of stains or of other materials attached to or associated with a substrate. However, it is envisaged that the present invention can be applied where a requirement is the removal and/or neutralisation by an oxidative bleaching reaction of malodours or other undesirable components attached to or otherwise associated with a substrate. Furthermore, in the context of the present invention bleaching is to be understood as being restricted to any bleaching mechanism or process that does not require the presence of light or activation by light. Thus, photobleaching compositions and processes relying on the use of photobleach catalysts or photobleach activators and the presence of light are excluded from the present invention.

According to the present invention, one or both of the pretreatment composition and the wash liquor are substantially devoid of peroxygen bleach or a peroxy-based or -generating bleach system, whereby the catalytic bleaching by atmospheric oxygen or air will predominate. However, in this case it will be appreciated that small amounts of hydrogen peroxide or peroxy-based or -generating systems may be included in the composition, if desired. Therefore, by "substantially devoid of peroxygen bleach or peroxy-based or -generating bleach systems" is meant that the composition contains from 0 to 50%, preferably from 0 to 10%, more preferably from 0 to 5%, and optimally from 0 to 2% by molar weight on an oxygen basis, of peroxygen bleach or peroxy-based or -generating bleach systems. Preferably, however, the composition will be wholly devoid of peroxygen bleach or peroxy-based or -generating bleach systems.

Thus, at least 10%, preferably at least 50% and optimally at least 90% of any bleaching of the stain substrate is effected by oxygen sourced from the air.

According to the present invention, preferably one of the pretreatment composition and the wash liquor contains a peroxygen bleach or a peroxy-based or -generating system. The peroxy bleach may be a compound which is capable of yielding hydrogen peroxide in aqueous solution. Hydrogen peroxide sources are well known in the art. They include the alkali metal peroxides, organic peroxides such as urea peroxide, and inorganic persalts, such as the alkali metal perborates, percarbonates, perphosphates persilicates and persulphates. Mixtures of two or more such compounds may also be suitable.

Particularly preferred are sodium perborate tetrahydrate and, especially, sodium perborate monohydrate. Sodium perborate monohydrate is preferred because of its high active oxygen content. Sodium percarbonate may also be preferred for environmental reasons. The amount thereof in the composition of the invention usually will be within the range of about 5–35% by weight, preferably from 10–25% by weight.

Another suitable hydrogen peroxide generating system is a combination of a $C_1$–$C_4$ alkanol oxidase and a $C_1$–$C_4$ alkanol, especially a combination of methanol oxidase (MOX) and ethanol. Such combinations are disclosed in WO-A-9507972, which is incorporated herein by reference.

Alkylhydroxy peroxides are another class of peroxy bleaching compounds. Examples of these materials include cumene hydroperoxide and t-butyl hydroperoxide.

Organic peroxyacids may also be suitable as the peroxy bleaching compound. Such materials normally have the general formula:

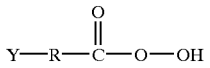

wherein R is an alkyl- or alkylidene- or substituted alkylene group containing from 1 to about 20 carbon atoms, optionally having an internal amide linkage; or a phenylene or substituted phenylene group; and Y is hydrogen, halogen, alkyl, aryl, an imido-aromatic or non-aromatic group, a —COOH or —COOOH group or a quaternary ammonium group.

Typical monoperoxy acids useful herein include, for example:

(i) peroxybenzoic acid and ring-substituted peroxybenzoic acids, e.g. peroxy-a-naphthoic acid;

(ii) aliphatic, substituted aliphatic and arylalkyl monoperoxyacids, e.g. peroxylauric acid, peroxystearic acid and N,N-phthaloylaminoperoxy caproic acid (PAP); and (iii) 6-octylamino-6-oxo-peroxyhexanoic acid.

Typical diperoxyacids useful herein include, for example:

(iv) 1,12-diperoxydodecanedioic acid (DPDA);

(v) 1,9-diperoxyazelaic acid;

(vi) diperoxybrassylic acid; diperoxysebacic acid and diperoxyisophthalic acid;

(vii) 2-decyldiperoxybutane-1,4-dioic acid; and (viii) 4,4'-sulphonylbisperoxybenzoic acid.

Also inorganic peroxyacid compounds are suitable, such as for example potassium monopersulphate (MPS). If organic or inorganic peroxyacids are used as the peroxygen compound, the amount thereof will normally be within the range of about 2–10% by weight, preferably from 4–8% by weight.

All these peroxy compounds may be utilized alone or in conjunction with a peroxyacid bleach precursor and/or an organic bleach catalyst not containing a transition metal.

Generally, the pretreatment composition can be suitably formulated to contain from 2 to 35%, preferably from 5 to 25% by weight, of the peroxy bleaching agent.

Peroxyacid bleach precursors are known and amply described in literature, such as in GB-A-836988; GB-A-864,798; GB-A-907,356; GB-A-1,003,310 and GB-A-1,519,351; DE-A-3,337,921; EP-A-0,185,522; EP-A-0,174,132; EP-A-0,120,591; and U.S. Pat. No. 1,246,339; U.S. Pat. No. 3,332,882; U.S. Pat. No. 4,128,494; U.S. Pat. No. 4,412,934 and U.S. Pat. No. 4,675,393.

Another useful class of peroxyacid bleach precursors is that of the cationic i.e. quaternary ammonium substituted peroxyacid precursors as disclosed in U.S. Pat. No. 4,751,015 and U.S. Pat. No. 4,397,757, in EP-A-0,284,292 and EP-A-331,229. Examples of peroxyacid bleach precursors of this class are:

2-(N,N,N-trimethyl ammonium) ethyl sodium-4-sulphophenyl carbonate chloride—(SPCC);

N-octyl,N,N-dimethyl-$N_{10}$-carbophenoxy decyl ammonium chloride—(ODC);

3-(N,N,N-trimethyl ammonium) propyl sodium-4-sulphophenyl carboxylate; and

N,N,N-trimethyl ammonium toluyloxy benzene sulphonate.

A further special class of bleach precursors is formed by the cationic nitriles as disclosed in EP-A-303,520; EP-A-458,396 and EP-A-464,880.

Any one of these peroxyacid bleach precursors can be used in the present invention, although some may be more preferred than others.

Of the above classes of bleach precursors, the preferred classes are the esters, including acyl phenol sulphonates and acyl alkyl phenol sulphonates; the acyl-amides; and the quaternary ammonium substituted peroxyacid precursors including the cationic nitriles.

Examples of said preferred peroxyacid bleach precursors or activators are sodium-4-benzoyloxy benzene sulphonate (SBOBS); N,N,N'N'-tetraacetyl ethylene diamine (TAED); sodium-1-methyl-2-benzoyloxy benzene-4-sulphonate; sodium-4-methyl-3-benzoloxy benzoate; 2-(N,N,N-trimethyl ammonium) ethyl sodium-4-sulphophenyl carbonate chloride (SPCC); trimethyl ammonium toluyloxybenzene sulphonate; sodium nonanoyloxybenzene sulphonate (SNOBS); sodium 3,5,5-trimethyl hexanoyloxybenzene sulphonate (STHOBS); and the substituted cationic nitriles.

The precursors may be used in an amount of up to 12%, preferably from 2–10% by weight, of the pretreatment composition.

The method of the present invention has particular application as a pretreatment in detergent bleaching, especially for laundry cleaning. Accordingly, the method preferably uses a wash liquor that contains a surface-active material, optionally together with detergency builder.

Optionally, the pretreatment composition may also include a surface-active material, optionally together with detergency builder. The pretreatment composition may contain a surface-active material in an amount, for example, of from 10 to 50% by weight.

The surface-active material may be naturally derived, such as soap, or a synthetic material selected from anionic, nonionic, amphoteric, zwitterionic, cationic actives and mixtures thereof. Many suitable actives are commercially available and are fully described in the literature, for example in "Surface Active Agents and Detergents", Volumes I and II, by Schwartz, Perry and Berch.

Typical synthetic anionic surface-actives are usually water-soluble alkali metal salts of organic sulphates and sulphonates having alkyl groups containing from about 8 to about 22 carbon atoms, the term "alkyl" being used to include the alkyl portion of higher aryl groups. Examples of suitable synthetic anionic detergent compounds are sodium and ammonium alkyl sulphates, especially those obtained by sulphating higher ($C_8$–$C_{18}$) alcohols produced, for example, from tallow or coconut oil; sodium and ammonium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil fatty acid monoglyceride sulphates and sulphonates; sodium and ammonium salts of sulphuric acid esters of higher ($C_9$–$C_{18}$) fatty alcohol alkylene oxide, particularly ethylene oxide, reaction products; the reaction products of fatty acids such as coconut fatty acids esterified with isethionic acid and neutralised with sodium hydroxide; sodium and ammonium salts of fatty acid amides of methyl taurine; alkane monosulphonates such as those derived by reacting alpha-olefins ($C_8$–$C_{20}$) with sodium bisulphite and those derived by reacting paraffins with $SO_2$ and $Cl_2$ and then hydrolysing with a base to produce a random sulphonate; sodium and ammonium ($C_7$–$C_{12}$) dialkyl sulphosuccinates; and olefin sulphonates, which term is used to describe material made by reacting olefins, particularly ($C_{10}$–$C_{20}$) alpha-olefins, with $SO_3$ and then neutralising and hydrolysing the reaction product. The preferred anionic detergent compounds are sodium ($C_{10}$–$C_{15}$) alkylbenzene sulphonates, and sodium ($C_{16}$–$C_{18}$) alkyl ether sulphates.

Examples of suitable nonionic surface-active compounds which may be used, preferably together with the anionic surface-active compounds, include, in particular, the reaction products of alkylene oxides, usually ethylene oxide, with alkyl ($C_6$–$C_{22}$) phenols, generally 5–25 EO, i.e. 5–25 units of ethylene oxides per molecule; and the condensation products of aliphatic ($C_8$–$C_{18}$) primary or secondary linear or branched alcohols with ethylene oxide, generally 2–30 EO. Other so-called nonionic surface-actives include alkyl polyglycosides, sugar esters, long-chain tertiary amine oxides, long-chain tertiary phosphine oxides and dialkyl sulphoxides.

Amphoteric or zwitterionic surface-active compounds can also be used in the compositions of the invention but this is not normally desired owing to their relatively high cost. If any amphoteric or zwitterionic detergent compounds are used, it is generally in small amounts in compositions based on the much more commonly used synthetic anionic and nonionic actives.

The pretreatment composition will preferably comprise from 1 to 15% wt of anionic surfactant and from 10 to 40% by weight of nonionic surfactant. In a further preferred embodiment, the detergent active system is free from $C_1$–$C_{12}$ fatty acid soaps.

The pretreatment composition may also contain a detergency builder, for example in an amount of from about 5 to 80% by weight, preferably from about 10 to 60% by weight.

Builder materials may be selected from 1) calcium sequestrant materials, 2) precipitating materials, 3) calcium ion-exchange materials and 4) mixtures thereof.

Examples of calcium sequestrant builder materials include alkali metal polyphosphates, such as sodium tripolyphosphate; nitrilotriacetic acid and its water-soluble salts; the alkali metal salts of carboxymethyloxy succinic acid, ethylene diamine tetraacetic acid, oxydisuccinic acid, mellitic acid, benzene polycarboxylic acids, citric acid; and polyacetal carboxylates as disclosed in U.S. Pat. No. 4,144,226 and U.S. Pat. No. 4,146,495.

Examples of precipitating builder materials include sodium orthophosphate and sodium carbonate.

Examples of calcium ion-exchange builder materials include the various types of water-insoluble crystalline or amorphous aluminosilicates, of which zeolites are the best known representatives, e.g. zeolite A, zeolite B (also known as zeolite P), zeolite C, zeolite X, zeolite Y and also the zeolite P-type as described in EP-A-0,384,070.

In particular, the pretreatment composition or wash liquor may contain any one of the organic and inorganic builder materials, though, for environmental reasons, phosphate builders are preferably omitted or only used in very small amounts. Typical builders usable in the present invention are, for example, sodium carbonate, calcite/carbonate, the sodium salt of nitrilotriacetic acid, sodium citrate, carboxymethyloxy malonate, carboxymethyloxy succinate and water-insoluble crystalline or amorphous aluminosilicate builder materials, each of which can be used as the main builder, either alone or in admixture with minor amounts of other builders or polymers as co-builder.

It is preferred that the pretreatment composition contains not more than 5% by weight of a carbonate builder, expressed as sodium carbonate, more preferably not more than 2.5% by weight to substantially nil, if the composition pH lies in the lower alkaline region of up to 10.

Apart from the components already mentioned, the pretreatment composition or wash liquor can contain any of the conventional additives in amounts of which such materials are normally employed in fabric washing detergent compositions. Examples of these additives include buffers such as carbonates, lather boosters, such as alkanolamides, particularly the monoethanol amides derived from palmkernel fatty acids and coconut fatty acids; lather depressants, such as alkyl phosphates and silicones; anti-redeposition agents, such as sodium carboxymethyl cellulose and alkyl or substituted alkyl cellulose ethers; stabilisers, such as phosphonic acid derivatives (i.e. Dequest® types); fabric softening agents; inorganic salts and alkaline buffering agents, such as sodium sulphate and sodium silicate; and, usually in very small amounts, fluorescent agents; perfumes; enzymes, such as proteases, cellulases, lipases, amylases and oxidases; germicides and colourants.

Transition metal sequestrants such as EDTA, and phosphonic acid derivatives such as EDTMP (ethylene diamine tetra(methylene phosphonate)) may also be included, in addition to the catalyst ligand specified, for example to improve the stability sensitive ingredients such as enzymes, fluorescent agents and perfumes, but provided the composition remains bleaching effective. However, the pretreatment composition containing the catalyst, is preferably substantially, and more preferably completely, devoid of transition metal sequestrants (other than the catalyst ligand).

Throughout the description and claims generic groups have been used, for example alkyl, alkoxy, aryl. Unless otherwise specified the following are preferred group restrictions that may be applied to generic groups found within compounds disclosed herein:

alkyl: linear and branched C1–C8-alkyl, alkenyl: C2–C6-alkenyl, cycloalkyl: C3–C8-cycloalkyl, alkoxy: C1–C6-alkoxy, alkylene: selected from the group consisting of: methylene; 1,1-ethylene; 1,2-ethylene; 1,1-propylidene; 1,2-propylene; 1,3-propylene; 2,2-propylidene; butan-2-ol-1,4-diyl; propan-2-ol-1,3-diyl; 1,4-butylene; cyclohexane-1,1-diyl; cyclohexan-1,2-diyl; cyclohexan-1,3-diyl; cyclohexan-1,4-diyl; cyclopentane-1,1-diyl; cyclopentan-1,2-diyl; and cyclopentan-1,3-diyl, aryl: selected from homoaromatic compounds having a molecular weight under 300, arylene: selected from the group consisting of: 1,2-phenylene; 1,3-phenylene; 1,4-phenylene; 1,2-naphtalenylene; 1,3-naphtalenylene; 1,4-naphtalenylene; 2,3-naphtalenylene; 1-hydroxy-2,3-phenylene; 1-hydroxy-2,4-phenylene; 1-hydroxy-2,5-phenylene; and 1-hydroxy-2,6-phenylene, heteroaryl: selected from the group consisting of: pyridinyl; pyrimidinyl; pyrazinyl; triazolyl; pyridazinyl; 1,3,5-triazinyl; quinolinyl; isoquinolinyl; quinoxalinyl; imidazolyl; pyrazolyl; benzimidazolyl; thiazolyl; oxazolidinyl; pyrrolyl; carbazolyl; indolyl; and isoindolyl, wherein the heteroaryl may be connected to the compound via any atom in the ring of the selected heteroaryl, heteroarylene: selected from the group consisting of: pyridindiyl; quinolindiyl; pyrazodiyl; pyrazoldiyl; triazolediyl; pyrazindiyl; and imidazolediyl, wherein the heteroarylene acts as a bridge in the compound via any atom in the ring of the selected heteroarylene, more specifically preferred are: pyridin-2,3-diyl; pyridin-2,4-diyl; pyridin-2,5-diyl; pyridin-2,6-diyl; pyridin-3,4-diyl; pyridin-3,5-diyl; quinolin-2,3-diyl; quinolin-2,4-diyl; quinolin-2,8-diyl; isoquinolin-1,3-diyl; isoquinolin-1,4-diyl; pyrazol-1,3-diyl; pyrazol-3,5-diyl; triazole-3,5-diyl; triazole-1,3-diyl; pyrazin-2,5-diyl; and imidazole-2,4-diyl, heterocycloalkyl: selected from the group consisting of: pyrrolinyl; pyrrolidinyl; morpholinyl; piperidinyl; piperazinyl; hexamethylene imine; 1,4-piperazinyl; tetrahydrothiophenyl; tetrahydrofuranyl; 1,4,7-triazacyclononanyl; 1,4,8,11-tetraazacyclotetradecanyl; 1,4,7,10,13-pentaazacyclopentadecanyl; 1,4-diaza-7-thia-cyclononanyl; 1,4-diaza-7-oxa-cyclononanyl; 1,4,7,10-tetraazacyclododecanyl; 1,4-dioxanyl; 1,4,7-trithiacyclononanyl; tetrahydropyranyl; and oxazolidinyl, wherein the heterocycloalkyl may be connected to the compound via any atom in the ring of the selected heterocycloalkyl, heterocycloalkylene: selected from the group consisting of: piperidin-1,2-ylene; piperidin-2,6-ylene; piperidin-4,4-ylidene; 1,4-piperazin-1,4-ylene; 1,4-piperazin-2,3-ylene; 1,4-piperazin-2,5-ylene; 1,4-piperazin-2,6-ylene; 1,4-piperazin-1,2-ylene; 1,4-piperazin-1,3-ylene; 1,4-piperazin-1,4-ylene; tetrahydrothiophen-2,5-ylene; tetrahydrothiophen-3,4-ylene; tetrahydrothiophen-2,3-ylene; tetrahydrofuran-2,5-ylene; tetrahydrofuran-3,4-ylene; tetrahydrofuran-2,3-ylene; pyrrolidin-2,5-ylene; pyrrolidin-3,4-ylene; pyrrolidin-2,3-ylene; pyrrolidin-1,2-ylene; pyrrolidin-1,3-ylene; pyrrolidin-2,2-ylidene; 1,4,7-triazacyclonon-1,4-ylene; 1,4,7-triazacyclonon-2,3-ylene; 1,4,7-triazacyclonon-2,9-ylene; 1,4,7-triazacyclonon-3,8-ylene; 1,4,7-triazacyclonon-2,2-ylidene; 1,4,8,11-tetraazacyclotetradec-1,4-ylene; 1,4,8,11-tetraazacyclotetradec-1,8-ylene; 1,4,8,11-tetraazacyclotetradec-2,3-ylene; 1,4,8,11-tetraazacyclotetradec-2,5-ylene; 1,4,8,11-tetraazacyclotetradec-1,2-ylene; 1,4,8,11-tetraazacyclotetradec-2,2-ylidene; 1,4,7,10-tetraazacyclododec-1,4-ylene; 1,4,7,10-tetraazacyclododec-1,7-ylene; 1,4,7,10-tetraazacyclododec-1,2-ylene; 1,4,7,10-tetraazacyclododec-2,3-ylene; 1,4,7,10-tetraazacyclododec-2,2-ylidene; 1,4,7,10,13-pentaazacyclopentadec-1,4-ylene; 1,4,7,10,13-pentaazacyclopentadec-1,7-ylene; 1,4,7,10,13-pentaazacyclopentadec-2,3-ylene; 1,4,7,10,13-pentaazacyclopentadec-1,2-ylene; 1,4,7,10,13-pentaazacyclopentadec-2,2-ylidene; 1,4-diaza-7-thia-cyclonon-1,4-ylene; 1,4-diaza-7-thia-cyclonon-1,2-ylene; 1,4-diaza-7-thia-cyclonon-2,3-ylene; 1,4-diaza-7-thia-cyclonon-6,8-ylene; 1,4-diaza-7-thia-cyclonon-2,2-ylidene; 1,4-diaza-7-oxa-cyclonon-1,4-ylene; 1,4-diaza-7-oxa-cyclonon-1,2-ylene; 1,4-diaza-7-oxa-cyclonon-2,3-ylene; 1,4-diaza-7-oxa-cyclonon-6,8-ylene; 1,4-diaza-7-oxa-cyclonon-2,2-ylidene; 1,4-dioxan-2,3-ylene; 1,4-dioxan-2,6-ylene;1,4-dioxan-2,2-ylidene; tetrahydropyran-2,3-ylene; tetrahydropyran-2,6-ylene; tetrahydropyran-2,5-ylene; tetrahydropyran-2,2-ylidene; 1,4,7-trithia-cyclonon-2,3-ylene; 1,4,7-trithia-cyclonon-2,9-ylene; and 1,4,7-trithia-cyclonon-2,2-ylidene, amine: the group —$N(R)_2$ wherein each R is independently selected from: hydrogen; C1–C6-alkyl; C1–C6-alkyl-C6H5; and phenyl, wherein when both R are C1–C6-alkyl both R together may form an —NC3 to an —NC5 heterocyclic ring with any remaining alkyl chain forming an alkyl substituent to the heterocyclic ring, halogen: selected from the group consisting of: F; Cl; Br and I, sulfonate: the group —$S(O)_2OR$, wherein R is selected from: hydrogen; C1–C6-alkyl; phenyl; C1–C6-alkyl-C6H5; Li; Na; K; Cs; Mg; and Ca, sulfate: the group —$S(O)_2OR$, wherein R is selected from: hydrogen; C1–C6-alkyl; phenyl; C1–C6-alkyl-C6H5; Li; Na; K; Cs; Mg; and Ca, sulfone: the group —$S(O)_2R$, wherein R is selected from: hydrogen; C1–C6-alkyl; phenyl; C1–C6-alkyl-C6H5 and amine (to give sulfonamide) selected from the group: —NR'2, wherein each R' is independently selected from: hydrogen; C1–C6-alkyl; C1–C6-alkyl-C6H5; and phenyl, wherein when both R' are C1–C6-alkyl both R' together may form an —NC3 to an —NC5 heterocyclic ring with any remaining alkyl chain forming an alkyl substituent to the heterocyclic ring, carboxylate derivative: the group —C(O)OR, wherein R is selected from: hydrogen; C1–C6-alkyl; phenyl; C1–C6-alkyl-C6H5; Li; Na; K; Cs; Mg; and Ca, carbonyl derivative: the group —C(O)R, wherein R is selected from: hydrogen; C1–C6-alkyl; phenyl; C1–C6-alkyl-C6H5 and amine (to give amide) selected from the group: —NR'2, wherein each R' is independently selected from: hydrogen; C1–C6-alkyl; C1–C6-alkyl-C6H5; and phenyl, wherein when both R' are C1–C6-alkyl both R' together may form an —NC3 to an —NC5 heterocyclic ring with any remaining alkyl chain forming an alkyl substituent to the heterocyclic ring, phosphonate: the group —P(O) $(OR)_2$, wherein each R is independently selected from: hydrogen; C1–C6-alkyl; phenyl; C1–C6-alkyl-C6H5; Li; Na; K; Cs; Mg; and Ca, phosphate: the group —OP(O) $(OR)_2$, wherein each R is independently selected from: hydrogen; C1–C6-alkyl; phenyl; C1–C6-alkyl-C6H5; Li; Na; K; Cs; Mg; and Ca, phosphine: the group —$P(R)_2$, wherein each R is independently selected from: hydrogen; C1–C6-alkyl; phenyl; and C1–C6-alkyl-C6H5, phosphine oxide: the group —$P(O)R_2$, wherein R is independently selected from: hydrogen; C1–C6-alkyl; phenyl; and C1–C6-alkyl-C6H5; and amine (to give phosphonamidate) selected from the group: —NR'2, wherein each R' is independently selected from: hydrogen; C1–C6-alkyl; C1–C6-alkyl-C6H5;

and phenyl, wherein when both R' are C1–C6-alkyl both R' together may form an —NC3 to an —NC5 heterocyclic ring with any remaining alkyl chain forming an alkyl substituent to the heterocyclic ring.

Unless otherwise specified the following are more preferred group restrictions that may be applied to groups found within compounds disclosed herein:

alkyl: linear and branched C1–C6-alkyl, alkenyl: C3–C6-alkenyl, cycloalkyl: C6–C8-cycloalkyl, alkoxy: C1–C4-alkoxy, alkylene: selected from the group consisting of: methylene; 1,2-ethylene; 1,3-propylene; butan-2-ol-1,4-diyl; 1,4-butylene; cyclohexane-1,1-diyl; cyclohexan-1,2-diyl; cyclohexan-1,4-diyl; cyclopentane-1,1-diyl; and cyclopentan-1,2-diyl, aryl: selected from group consisting of: phenyl; biphenyl; naphthalenyl; anthracenyl; and phenanthrenyl, arylene: selected from the group consisting of: 1,2-phenylene; 1,3-phenylene; 1,4-phenylene; 1,2-naphtalenylene; 1,4-naphtalenylene; 2,3-naphtalenylene and 1-hydroxy-2,6-phenylene, heteroaryl: selected from the group consisting of: pyridinyl; pyrimidinyl; quinolinyl; pyrazolyl; triazolyl; isoquinolinyl; imidazolyl; and oxazolidinyl, wherein the heteroaryl may be connected to the compound via any atom in the ring of the selected heteroaryl, heteroarylene: selected from the group consisting of: pyridin-2,3-diyl; pyridin-2,4-diyl; pyridin-2,6-diyl; pyridin-3,5-diyl; quinolin-2,3-diyl; quinolin-2,4-diyl; isoquinolin-1,3-diyl; isoquinolin-1,4-diyl; pyrazol-3,5-diyl; and imidazole-2,4-diyl, heterocycloalkyl: selected from the group consisting of: pyrrolidinyl; morpholinyl; piperidinyl; piperidinyl; 1,4-piperazinyl; tetrahydrofuranyl; 1,4,7-triazacyclononanyl; 1,4,8,11-tetraazacyclotetradecanyl; 1,4,7,10,13-pentaazacyclopentadecanyl; 1,4,7,10-tetraazacyclododecanyl; and piperazinyl, wherein the heterocycloalkyl may be connected to the compound via any atom in the ring of the selected heterocycloalkyl, heterocycloalkylene: selected from the group consisting of: piperidin-2,6-ylene; piperidin-4,4-ylidene; 1,4-piperazin-1,4-ylene; 1,4-piperazin-2,3-ylene; 1,4-piperazin-2,6-ylene; tetrahydrothiophen-2,5-ylene; tetrahydrothiophen-3,4-ylene; tetrahydrofuran-2,5-ylene; tetrahydrofuran-3,4-ylene; pyrrolidin-2,5-ylene; pyrrolidin-2,2-ylidene; 1,4,7-triazacyclonon-1,4-ylene; 1,4,7-triazacyclonon-2,3-ylene; 1,4,7-triazacyclonon-2,2-ylidene; 1,4,8,11-tetraazacyclotetradec-1,4-ylene; 1,4,8,11-tetraazacyclotetradec-1,8-ylene;

1,4,8,11-tetraazacyclotetradec-2,3-ylene; 1,4,8,11-tetraazacyclotetradec-2,2-ylidene; 1,4,7,10-tetraazacyclododec-1,4-ylene; 1,4,7,10-tetraazacyclododec-1,7-ylene; 1,4,7,10-tetraazacyclododec-2,3-ylene; 1,4,7,10-tetraazacyclododec-2,2-ylidene; 1,4,7,10,13-pentaazacyclopentadec-1,4-ylene; 1,4,7,10,13-pentaazacyclopentadec-1,7-ylene; 1,4-diaza-7-thia-cyclonon-1,4-ylene; 1,4-diaza-7-thia-cyclonon-2,3-ylene; 1,4-diaza-7-thia-cyclonon-2,2-ylidene; 1,4-diaza-7-oxa-cyclonon-1,4-ylene; 1,4-diaza-7-oxa-cyclonon-2,3-ylene; 1,4-diaza-7-oxa-cyclonon-2,2-ylidene; 1,4-dioxan-2,6-ylene; 1,4-dioxan-2,2-ylidene; tetrahydropyran-2,6-ylene; tetrahydropyran-2,5-ylene; and tetrahydropyran-2,2-ylidene, amine: the group —$N(R)_2$, wherein each R is independently selected from: hydrogen; C1–C6-alkyl; and benzyl, halogen: selected from the group consisting of: F and Cl, sulfonate: the group —$S(O)_2OR$, wherein R is selected from: hydrogen; C1–C6-alkyl; Na; K; Mg; and Ca, sulfate: the group —$OS(O)_2OR$, wherein R is selected from: hydrogen; C1–C6-alkyl; Na; K; Mg; and Ca, sulfone: the group —$S(O)_2R$, wherein R is selected from: hydrogen; C1–C6-alkyl; benzyl and amine selected from the group: —NR'2, wherein each R' is independently selected from: hydrogen; C1–C6-alkyl; and benzyl, carboxylate derivative: the group —C(O)OR, wherein R is selected from hydrogen; Na; K; Mg; Ca; C1–C6-alkyl; and benzyl, carbonyl derivative: the group: —C(O)R, wherein R is selected from: hydrogen; C1–C6-alkyl; benzyl and amine selected from the group: —NR' 2, wherein each R' is independently selected from: hydrogen; C1–C6-alkyl; and benzyl, phosphonate: the group —P(O) $(OR)_2$, wherein each R is independently selected from: hydrogen; C1–C6-alkyl; benzyl; Na; K; Mg; and Ca, phosphate: the group —OP(O) $(OR)_2$, wherein each R is independently selected from: hydrogen; C1–C6-alkyl; benzyl; Na; K; Mg; and Ca, phosphine: the group —$P(R)_2$, wherein each R is independently selected from: hydrogen; C1–C6-alkyl; and benzyl, phosphine oxide: the group —P(O)$R_2$, wherein R is independently selected from: hydrogen; C1–C6-alkyl; benzyl and amine selected from the group: —NR'2, wherein each R' is independently selected from: hydrogen; C1–C6-alkyl; and benzyl.

The invention will now be further illustrated by way of the following non-limiting examples:

EXAMPLES

Example 1

In Example 1 the iron perchlorate complex of MeN4Py [(MeN4Py)Fe($CH_3CN$)] $(ClO_4)_2$] was used. The iron perchlorate complex of MeN4Py was obtained according to the procedure found in EP-A-0909809 A. Pre-treatment systems were tested as follows:

A pre-treatment system, 2 ml of each, were added to either BC-1 or Pomarola/soya oil stains on cotton fabric, and left for either 0 or 60 minutes prior to washing in 1.75 g/l detergent base in 15° FH (all $Ca^{2+}$) water at 25° C. in a tergotometer (80 opm).

The detergent base powder composition is given below:

| Component | Parts by weight |
|---|---|
| LAS (linear alkylbenzene sulfonate) | 28 |
| Sodium sulphate | 10.258 |
| STP | 28 |
| Alkaline silicate | 9.9778 |
| Fluorescer | 0.24 |
| EDTA | 0.009 |
| SCMC (Na carboxymethylcellulose) | 1.12 |
| Water | 10.222 |
| TOTAL | 87.627 |

The following pretreatment compositions were used:

(a) 'no pretreat' (main wash only)

(b) 'water' (blank): aqueous solution 0.2% STP and 0.05% Dequest, pH 9.6

(c) '8cat': 8 $\mu$M catalyst in aqueous solution 0.2% STP and 0.05% Dequest, pH 9.6

(d) '8cat/perox': 8 $\mu$M catalyst in aqueous solution 7% $H_2O_2$, 0.2% STP and 0.05% Dequest, pH 9.6

(e) '20cat': 20 $\mu$M catalyst in aqueous solution, 0.2% STP, 0.05% Dequest, pH 9.6

(f) '20cat/perox': 20 $\mu$M catalyst in aqueous solution 7% $H_2O_2$, 0.2% STP and 0.05% Dequest, pH 9.6

(g) 'perox' (blank): aqueous solution 7% $H_2O_2$ (h) 'oil' (blank): oleic acid (i) 'oil-8cat': 8 $\mu$M catalyst in oleic acid (j) 'oil-20cat': 20 $\mu$M catalyst in oleic acid $\Delta E_{aw}$ (aw=after wash) values were measured as follows: After the wash, the cloths were rinsed with water and subsequently dried at ambient temperature in the dark and the change in colour was measured after leaving the cloths for 24 h in the dark with an Ultrascan XE spectrophotometer (ex Hunterlab). The change in colour (including bleaching) is expressed as the $\Delta E_{aw}$ value relative to clean white cotton. The measured colour difference ($\Delta E_{aw}$) between the washed cloth and the clean white cotton cloth is defined as follows:

$$\Delta E_{aw}=[(\Delta L)^2+(\Delta a)^2+(\Delta b)^2]^{1/2}$$

wherein $\Delta L$ is a measure for the difference in darkness between the washed and clean white cloth; $\Delta a$ and $\Delta b$ are measures for the difference in redness and yellowness respectively between both cloths. With regard to this colour measurement technique, reference is made to Commission International de l'Eclairage (CIE); Recommendation on Uniform Colour Spaces, colour difference equations, psychometric colour terms, supplement no 2 to CIE Publication, no 15, Colormetry, Bureau Central de la CIE, Paris 1978.

The results are shown in Tables 1 and 2 below.

TABLE 1

Tea (BCl) stain - effect of pre-treatment with Fe-catalyst

| | Eaw | |
|---|---|---|
| | 0 min pre-treat | 60 min pre-treat |
| No pre-treat | 20.3 | 20.3 |
| Water | 20.7 | 20.4 |
| 8cat | 20.7 | 20.7 |
| 8cat/perox | 15.1 | 7.5 |
| 20cat | 20.9 | 20.6 |
| 20cat/perox | 14.2 | 6.7 |
| Perox | 16.0 | 9.5 |
| Oil | 21.0 | 21.1 |
| Oil-8cat | 20.3 | 20.4 |
| Oil-20cat | 20.2 | 20.3 |

TABLE 2

Pomarola/oil stain - effect of pre-treatment with Fe-catalyst

| | Eaw | |
|---|---|---|
| | 0 min pre-treat | 60 min pre-treat |
| No pre-treat | 15.1 | 14.9 |
| Water | 11.5 | 11.8 |
| 8cat | 5.5 | 4.3 |
| 8cat/perox | 11.6 | 11.2 |
| 20cat | 3.7 | 2.9 |
| 20cat/perox | 7.1 | 6.8 |
| Perox | 16 | 15.5 |
| Oil | 5.6 | 3.4 |
| Oil-8cat | 3.0 | 2.2 |
| Oil-20cat | 2.7 | 2.0 |

Example 2

In Example 2 the iron chloride complex of MeN4py [FeMeN4py$Cl_2$] was used. The iron chloride complex of MeN4py was prepared as follows from the MeN4py ligand synthesised as in EP 0909809. MeN4Py ligand (33.7 g; 88.5 mmoles) was dissolved in 500 ml dry methanol. Small portions of $FeCl_2.4H_2O$ (0.95 eq; 16.7 g; 84.0 mmoles) were added, yielding a clear red solution. After addition, the solution was stirred for 30 minutes at room temperature, after which the methanol was removed (rotary-evaporator). The dry solid was ground and 150 ml of ethylacetate was added and the mixture was stirred until a fine red powder was obtained. This powder was washed twice with ethyl acetate, dried in the air and further dried under vacuum (40° C.). El. Anal. Calc. for [Fe(MeN4py)Cl]Cl.2$H_2O$: C 53.03; H 5.16; N 12.89; Cl 13.07; Fe 10.01%. Found C 52.29/52.03; H 5.05/5.03; N 12.55/12.61; Cl: 12.73/12.69; Fe: 10.06/10.01%.

Oils were applied on the BC-1 cloth by the following procedure. First an oil was dissolved in a heptane solution (40 mg liquid per ml heptane solution), then 0.72 ml of this solution was applied to a BC-1 (tea) cloth of 6×6 cm, yielding 5% oil on the cloth. The two oils employed were medium chain triglyceride oil (fully saturated oil) and sunflower oil (SF) (poly-unsaturated oil containing a high quantity of 2 or 3 double bonds in the esterified fatty acid chains). Subsequently the cloths were brought into contact with a 10 mM carbonate buffer solution (pH 10) containing 10 microM of $FeMeN4pyCl_2$ in and mixed for 30 minutes at 30° C. (liquor-to-cloth ratio of 40:1). In comparative experiments the same cloths were treated without the iron catalyst in the buffer solution.

After incubation, the cloths were washed three times with demin-water, then dried in a tumble drier and stored in the dark (wrapped in aluminum foil). The bleach results of the cloths, obtained after various periods of times are given in the table below. The reflectance of the cloths was measured with a Minolta™ 3700d spectrophotometer at 460 nm. The difference in reflectance before and after the wash/storage is defined as a ΔR460 value; a higher value indicates a better bleaching of the BC-1 stain. The bleaching values were determined immediately after the wash, after 4, 10, 17 and 24 days storage.

Table 3: bleaching performance of the iron catalyst on BC-1 in the absence of oil, in the presence of MCT oil and Sunflower oil. The bleaching activity is expressed as a ΔR460 value (a higher value indicates a cleaner cloth).

| | No oil −Fecat | No oil +Fecat | MCT oil −Fecat | MCT oil +Fecat | SF oil −Fecat | SF oil +Fecat |
|---|---|---|---|---|---|---|
| T = 0 day | 1.4 | 0.7 | −0.6 | −1.6 | −0.5 | −1.0 |
| T = 4 days | 1.7 | 1.0 | −0.3 | −1.5 | −0.5 | 1.2 |
| T = 10 days | 1.9 | 1.2 | −0.1 | −1.2 | −0.1 | 3.6 |
| T = 17 days | 2.2 | 1.8 | 0.6 | −0.5 | 0.6 | 4.5 |
| T = 24 days | 2.5 | 2.4 | 1.2 | −0.1 | 1.3 | 5.0 |

The results given in Table 3 are indicative of that the presence of unsaturated oil in treatment gives an increased BC-1 bleaching upon storage in the air (last column). Thus the pre-treatment of the stain with unsaturated oil yields as detailed above provides improved air bleaching.

What is claimed is:

1. A method of bleaching fabric stains comprising applying a pretreatment composition to a stained fabric, and subsequently washing the pretreated fabric in an aqueous wash liquor, wherein:

the liquid pretreatment composition comprises a pentadentate or hexadentate ligand which forms a complex with a transition metal, the complex catalysing bleaching of stains by atmospheric oxygen; and one or both of the pretreatment composition and the wash liquor are substantially devoid of peroxygen bleach or a peroxy-based or -generating bleach system.

2. A method according to claim 1, wherein one of the pretreatment composition and the wash liquor comprises peroxygen bleach or a peroxy-based or -generating bleach system, preferably hydrogen peroxide, and the other of the pretreatment composition and the wash liquor is substantially devoid of peroxygen bleach or a peroxy-based or -generating bleach system.

3. A method according to claim 2, wherein the pretreatment composition comprises the peroxygen bleach or peroxy-based or -generating bleach system.

4. A method according to claim 2, wherein the pretreatment composition is substantially devoid of peroxygen bleach or a peroxy-based or -generating bleach system.

5. A method according to claim 1, wherein the pretreatment composition comprises unsaturated fatty acid oil.

6. A method according to claim 1, wherein the pretreatment composition is applied to the stained fabric at least 5 minutes, preferably at least 15 minutes, more preferably at least 50 minutes, before washing.

7. A method according to according to claim 1, wherein the ligand forms a complex of the general formula:

$$[M_aL_kX_n]Y_m$$

in which:

M represents a metal selected from Mn(II)–(III)–(IV)–(V), Cu(I)–(II)–(III), Fe (II)–(III)–(IV)–(V), Co(I)–(II)–(III), Ti (II)–(III)–(IV), V(II)–(III)–(IV)–(V), Mo(II)–(III)–(IV)–(V)–(VI) and W(IV)–(V)–(VI), preferably from Fe (II)–(III)–(IV)–(V);

L represents the ligand, or its protonated or deprotonated analogue;

X represents a coordinating species selected from any mono, bi or tri charged anions and any neutral molecules able to coordinate the metal in a mono, bi or tridentate manner;

Y represents any non-coordinated counter ion;

a represents an integer from 1 to 10;

k represents an integer from 1 to 10;

n represents zero or an integer from 1 to 10;

m represents zero or an integer from 1 to 20.

8. A method according to claim 1, wherein the ligand is a pentadentate ligand of the general formula (IVE):

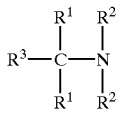

(IVE)

wherein each $R_1$, $R^2$ independently represents —$R^4$–$R^5$, $R^3$ represents hydrogen, optionally substituted alkyl, aryl or arylalkyl, or —$R^4$–$R^5$, each $R^4$ independently represents a single bond or optionally substituted alkylene, alkenylene, oxyalkylene, aminoalkylene, alkylene ether, carboxylic ester or carboxylic amide, and each $R^5$ independently represents an optionally N-substituted aminoalkyl group or an optionally substituted heteroaryl group selected from pyridinyl, pyrazinyl, pyrazolyl, pyrrolyl, imidazolyl, benzimidazolyl, pyrimidinyl, triazolyl and thiazolyl.

9. A method according to claim 8, wherein the ligand is N,N-bis(pyridin-2-yl-methyl)-1,1-bis(pyridin-2-yl)-1-aminoethane.

10. A method according to claim 1, wherein the pretreatment composition comprises a preformed complex of the ligand and the transition metal.

11. A method according to claim 1, wherein the pretreatment composition comprises free ligand that complexes with transition metal present in the wash liquor.

12. A method according to claim 1, wherein the pretreatment composition comprises free ligand that complexes with transition metal present in the stain.

13. A method according to claim 1, wherein the pretreatment composition comprises free ligand or a transition metal-substitutable metal-ligand complex, and a source of transition metal.

* * * * *